US010322895B2

(12) United States Patent
Momose et al.

(10) Patent No.: US 10,322,895 B2
(45) Date of Patent: Jun. 18, 2019

(54) MATERIAL CONVEYOR, TRANSFER DEVICE INCORPORATING THE MATERIAL CONVEYOR, IMAGE FORMING APPARATUS INCORPORATING THE TRANSFER DEVICE, METHOD OF POSITION CONTROL OF ROTARY BODIED, AND NON-TRANSITORY COMPUTER READABLE STORAGE MEDIUM

(71) Applicants: Daisuke Momose, Kanagawa (JP); Masahiro Ashikawa, Kanagawa (JP); Motoharu Takahashi, Kanagawa (JP); Yuuya Mizuguchi, Kanagawa (JP)

(72) Inventors: Daisuke Momose, Kanagawa (JP); Masahiro Ashikawa, Kanagawa (JP); Motoharu Takahashi, Kanagawa (JP); Yuuya Mizuguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/719,848

(22) Filed: Sep. 29, 2017

(65) Prior Publication Data

US 2018/0093841 A1 Apr. 5, 2018

(30) Foreign Application Priority Data

Sep. 30, 2016 (JP) ..... 2016-195268
Sep. 27, 2017 (JP) ..... 2017-186704

(51) Int. Cl.
*G03G 15/00* (2006.01)
*G03G 15/16* (2006.01)
*B65H 5/06* (2006.01)

(52) U.S. Cl.
CPC ..... *B65H 5/064* (2013.01); *G03G 15/1615* (2013.01); *G03G 15/6529* (2013.01);
(Continued)

(58) Field of Classification Search
CPC ..... B65H 5/064; B65H 2301/44318; B65H 2801/03
See application file for complete search history.

(56) References Cited

U.S. PATENT DOCUMENTS

2010/0028028 A1* 2/2010 Iwasaki ..... G03G 15/0147 399/39
2010/0034565 A1 2/2010 Ashikawa et al.
(Continued)

FOREIGN PATENT DOCUMENTS

JP 6-274051 9/1994
JP 2013-195949 9/2013
(Continued)

OTHER PUBLICATIONS

Extended European Search Report dated Jan. 26, 2018.

*Primary Examiner* — Victor Verbitsky
(74) *Attorney, Agent, or Firm* — Harness, Dickey & Pierce, P.L.C.

(57) ABSTRACT

A material conveyor, included in a transfer device of an image forming apparatus and configured to use position control of rotary bodies, includes a first rotary body and a second rotary body disposed opposing each other in an opposing region through which a material is conveyable, and a contact and separation device configured to cause at least a surface, of at least one of the first rotary body and the second rotary body to move, between a separated position and a contact position. The contact and separation device is configured to cause the at least the surface to move from the separated position to the contact position, at a first speed, and then to move at a second speed slower than the first speed. A method of position control includes moving at least the surface at different speeds or based on a distance relative to a threshold distance.

19 Claims, 12 Drawing Sheets

(52) U.S. Cl.
CPC ..... *B65H 2301/44318* (2013.01); *B65H 2404/144* (2013.01); *B65H 2513/10* (2013.01); *B65H 2801/03* (2013.01); *G03G 15/1605* (2013.01); *G03G 15/167* (2013.01); *G03G 15/50* (2013.01); *G03G 15/6564* (2013.01)

(56) References Cited

U.S. PATENT DOCUMENTS

| | | | |
|---|---|---|---|
| 2010/0239282 | A1 | 9/2010 | Ashikawa et al. |
| 2013/0121715 | A1 | 5/2013 | Ashikawa et al. |
| 2014/0314429 | A1 | 10/2014 | Asano |
| 2014/0334847 | A1 | 11/2014 | Takahashi et al. |
| 2015/0086239 | A1 | 3/2015 | Inuzuka |
| 2016/0139543 | A1 | 5/2016 | Imai et al. |

FOREIGN PATENT DOCUMENTS

| | | | |
|---|---|---|---|
| JP | 2014-211475 | | 11/2014 |
| JP | 2015-219369 | A | 12/2015 |
| JP | 2016-061828 | | 4/2016 |

* cited by examiner

FIG. 8
| FIG. 8A |
| --- |
| FIG. 8B |
FIG. 8A
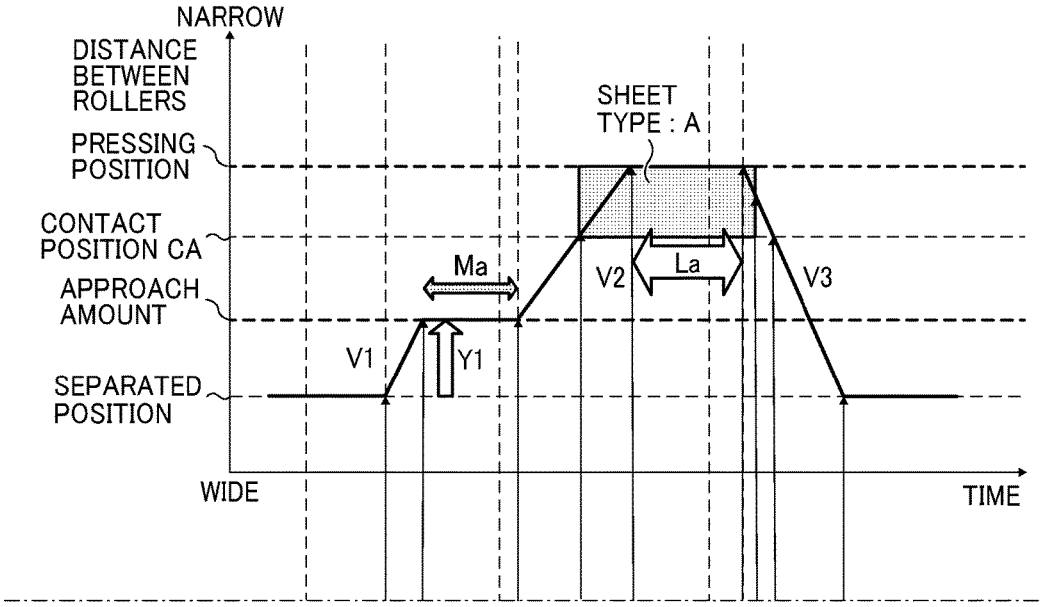
FIG. 8B
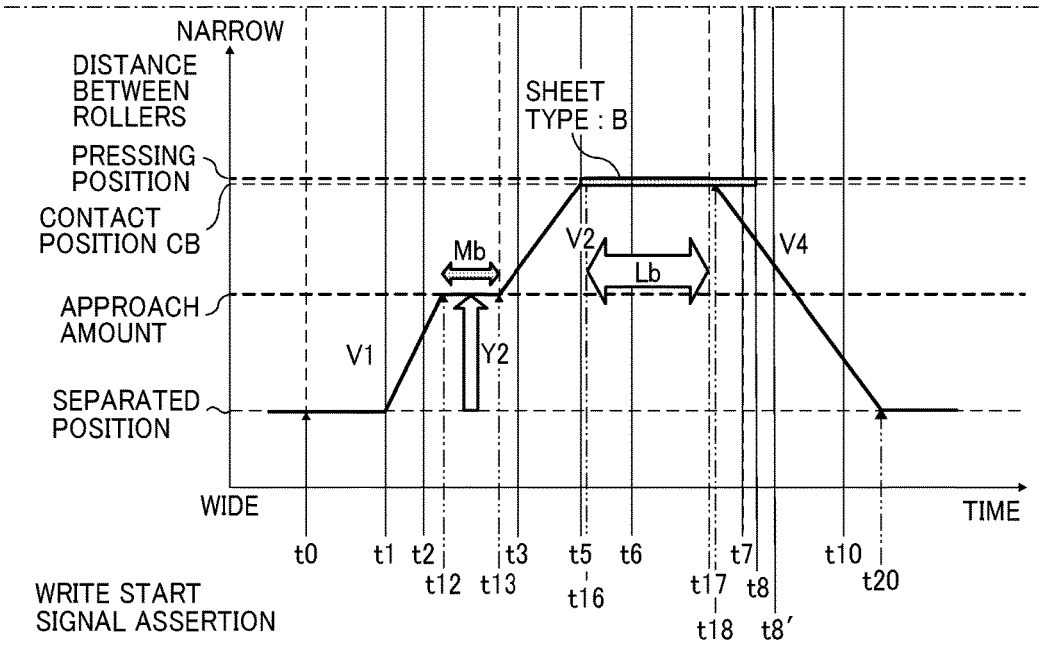

MATERIAL CONVEYOR, TRANSFER DEVICE INCORPORATING THE MATERIAL CONVEYOR, IMAGE FORMING APPARATUS INCORPORATING THE TRANSFER DEVICE, METHOD OF POSITION CONTROL OF ROTARY BODIED, AND NON-TRANSITORY COMPUTER READABLE STORAGE MEDIUM

CROSS-REFERENCE TO RELATED APPLICATIONS

This patent application is based on and claims priority pursuant to 35 U.S.C. § 119(a) to Japanese Patent Application Nos. 2016-195268, filed on Sep. 30, 2016, and 2017-186704, filed on Sep. 27, 2017, in the Japan Patent Office, the entire disclosure of each of which is hereby incorporated by reference herein.

BACKGROUND

Technical Field

This disclosure relates to a material conveyor that conveys a material such as a transfer target sheet, a transfer device that conveys the material, an image forming apparatus incorporating the transfer device including the material conveyor, a method of position control of rotary bodies in the material conveyor, and a non-transitory computer readable storage medium for performing the method of position control of the rotary bodies.

Related Art

In known image forming apparatuses including two rotary bodies to contact an image bearer such as an intermediate transfer belt to form a transfer nip region, when a recording medium passes through the transfer nip region, it is likely to cause shock jitters, which are linear image density nonuniformity. The linear image density nonuniformity occurs when a recording medium enters or exits the transfer nip region, due to abrupt change of a load to the image bearer to greatly change a linear velocity of the image bearer instantly.

In order to address this inconvenience, a known image forming apparatus includes a configuration in which shock jitters are reduced by adjusting an amount of separation (gap) between an intermediate transfer belt and a secondary transfer roller in contact with each other, according to a detected thickness of the recording medium.

SUMMARY

At least one aspect of this disclosure provides a material conveyor including a first rotary body, a second rotary body disposed opposing the first rotary body in an opposing region through which a material is conveyable, and a contact and separation device configured to cause at least a surface of at least one of the first rotary body and the second rotary body to move, between a separated position at which the first rotary body and the second rotary body are separated from each other and a contact position at which the first rotary body and the second rotary body contact the material. The contact and separation device is configured to cause the at least the surface of the at least one of the first rotary body and the second rotary body to move from the separated position to the contact position at a first speed from the separated position to a position between the separated position and the contact position, and a second speed, relatively slower than the first speed, from the position, between the separated position and the contact position, to the contact position after movement at the first speed.

Further, at least one aspect of this disclosure provides a transfer device including the above-described material conveyor. One of the first rotary body and the second rotary body includes an image bearer. An image borne on the first rotary body is transferred onto the material in the opposing region.

Further, at least one aspect of this disclosure provides an image forming apparatus including an image forming device configured to form an image on an image bearer, and the above-described transfer device.

Further, at least one aspect of this disclosure provides a method of position control of rotary bodies including moving at least a surface of at least one of a first rotary body and a second rotary body, disposed opposing the first rotary body, in a region between a separated position, at which the first rotary body and the second rotary body are separated from each other, and a contact position, at which the first rotary body and the second rotary body are configured to contact and convey the material. The moving includes moving the at least the surface of the at least one of the first rotary body and the second rotary body in the separated position at a first speed and moving the at least the surface of the at least one of the first rotary body and the second rotary body, prior to reaching the contact position, at a second speed relatively slower than the first speed.

Further, at least one aspect of this disclosure provides a non-transitory computer readable storage medium including program code segments to, when executed by a processor in an image forming apparatus, perform the above-described method.

Further, at least one aspect of this disclosure provides a method of position control of rotary bodies including moving at least a surface of at least one of a first rotary body and a second rotary body, disposed opposing the first rotary body, at a first speed when the first rotary body and the second rotary body are separated from each other, and at a second relatively slower speed when a distance between the first rotary body and the second rotary body reaches a threshold distance, prior to reaching a contact position at which the first rotary body and the second rotary body are configured to contact and convey a material.

Further, at least one aspect of this disclosure provides a non-transitory computer readable storage medium including program code segments to, when executed by a processor in an image forming apparatus, perform the above-described method.

BRIEF DESCRIPTION OF THE SEVERAL VIEWS OF THE DRAWINGS

An exemplary embodiment of this disclosure will be described in detail based on the following figured, wherein:

FIGS. 8A and 8B are timing charts illustrating positions of two rotary bodies in movement of contact and separation when sheets having different thicknesses from each other are conveyed;

DETAILED DESCRIPTION

Figure 1:
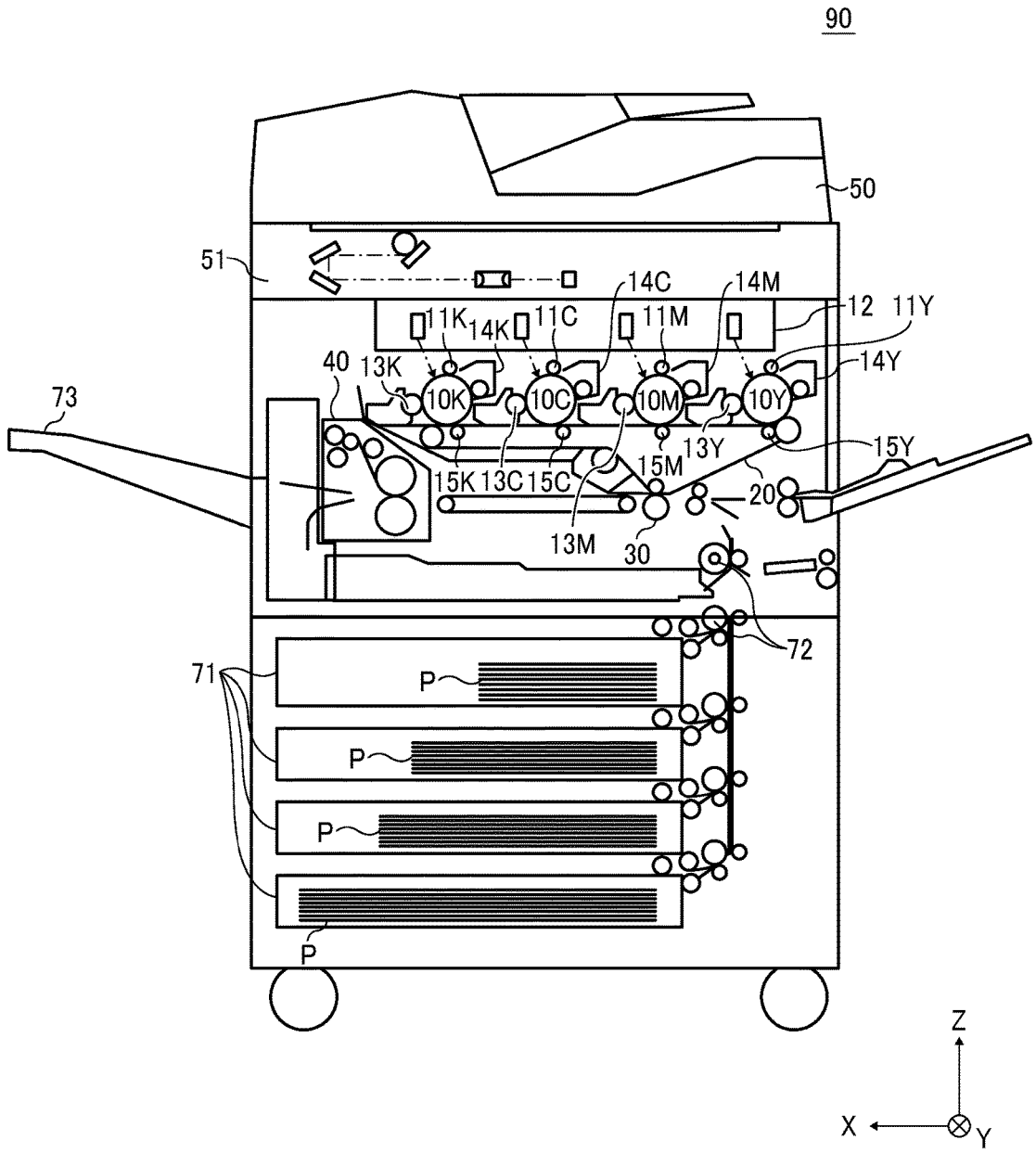
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms.

These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an image forming apparatus 90 according to an embodiment of this disclosure with reference to drawings. In each drawing, the same configuration shares the same reference numeral and the overlapped description is omitted.

Configuration of Image Forming Apparatus.

FIG. 1 is a diagram illustrating a schematic configuration of the image forming apparatus 90 according to an embodiment of this disclosure.

It is to be noted that identical parts are given identical reference numerals and redundant descriptions are summarized or omitted accordingly.

The image forming apparatus 90 may be a copier, a facsimile machine, a printer, a multifunction peripheral or a multifunction printer (MFP) having at least one of copying, printing, scanning, facsimile, and plotter functions, or the like. According to the present example, the image forming apparatus 90 is an electrophotographic image forming apparatus that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 90 is a multifunction printer that includes photoconductors 10K, 10C, 10M, and 10Y, charging devices 11K, 11C, 11M, and 11Y, an exposure device 12, developing devices 13K, 13C, 13M, and 13Y, cleaning devices 14K, 14C, 14M, and 14Y, an intermediate transfer belt 20, a secondary transfer roller 30, a fixing device 40, an automatic document feeder (ADF) 50, and an image reading device 51. The image forming apparatus 90 prints an image on a sheet P that is included in sheet trays 71 and outputs the sheet P from an apparatus body thereof.

It is to be noted that the sheet P used in the image forming apparatus 90 in this disclosure is an example of a sheet-like transfer target sheet or material.

When the image forming apparatus 90 prints an image on the sheet P, the charging device 11 (i.e., the charging devices 11K, 11C, 11M, and 11Y) uniformly charges the surface of the photoconductor 10 (i.e., the photoconductors 10K, 10C, 10M, and 10Y) while the photoconductor 10 is rotating. After the image reading device 51 has read image data of an original document set on the ADF 50, the exposure device 12 emits light to irradiate the surface of the photoconductor 10, so that an electrostatic latent image based on the image data read by the image reading device 51 is formed on the surface of the photoconductor 10.

Next, the developing device 13 (i.e., the developing devices 13K, 13C, 13M, and 13Y) that stores developer containing toner particles therein develops the electrostatic latent image formed on the surface of the photoconductor 10 into a visible toner image. As described above, the image forming apparatus 90 includes multiple photoconductors 10 (i.e., photoconductors 10K, 10C, 10M, and 10Y) and multiple developing devices 13 (i.e., the developing devices 13K, 13C, 13M, and 13Y). After having been formed on the respective photoconductors 10, respective single toner images are subsequently transferred and overlaid on the surface of the intermediate transfer belt 20. The photoconductors 10, the charging devices 11, the exposure device 12, and the developing devices 13 function as an image forming device as a single unit.

The toner image transferred onto the surface of the intermediate transfer belt 20 passes a secondary transfer nip region where the intermediate transfer belt 20 and the secondary transfer roller 30 are disposed opposing each other with the sheet P being held and conveyed therebetween. In the secondary transfer nip region, the toner image is secondarily transferred onto the sheet P delivered by a sheet feed roller 72 from a selected one of the sheet trays 71. The sheet P onto which the toner image has been transferred is then conveyed to the fixing device 40 where the toner image is fixed to the sheet P by application of heat and pressure. Thereafter, the sheet P is discharged to a sheet output tray 73.

After the toner image has been transferred onto the surface of the intermediate transfer belt 20, the photoconductor 10 (i.e., the photoconductors 10K, 10C, 10M, and 10Y) is cleaned by the cleaning device 14 (i.e., the cleaning devices 14K, 14C, 14M, and 14Y) by removing residual toner remaining on the surface of the photoconductor 10. By so doing, the photoconductor 10 is ready for a subsequent image forming operation.

Configuration of Sheet Conveyor Including Intermediate Transfer Belt and Secondary Transfer Roller.

Figure 2:
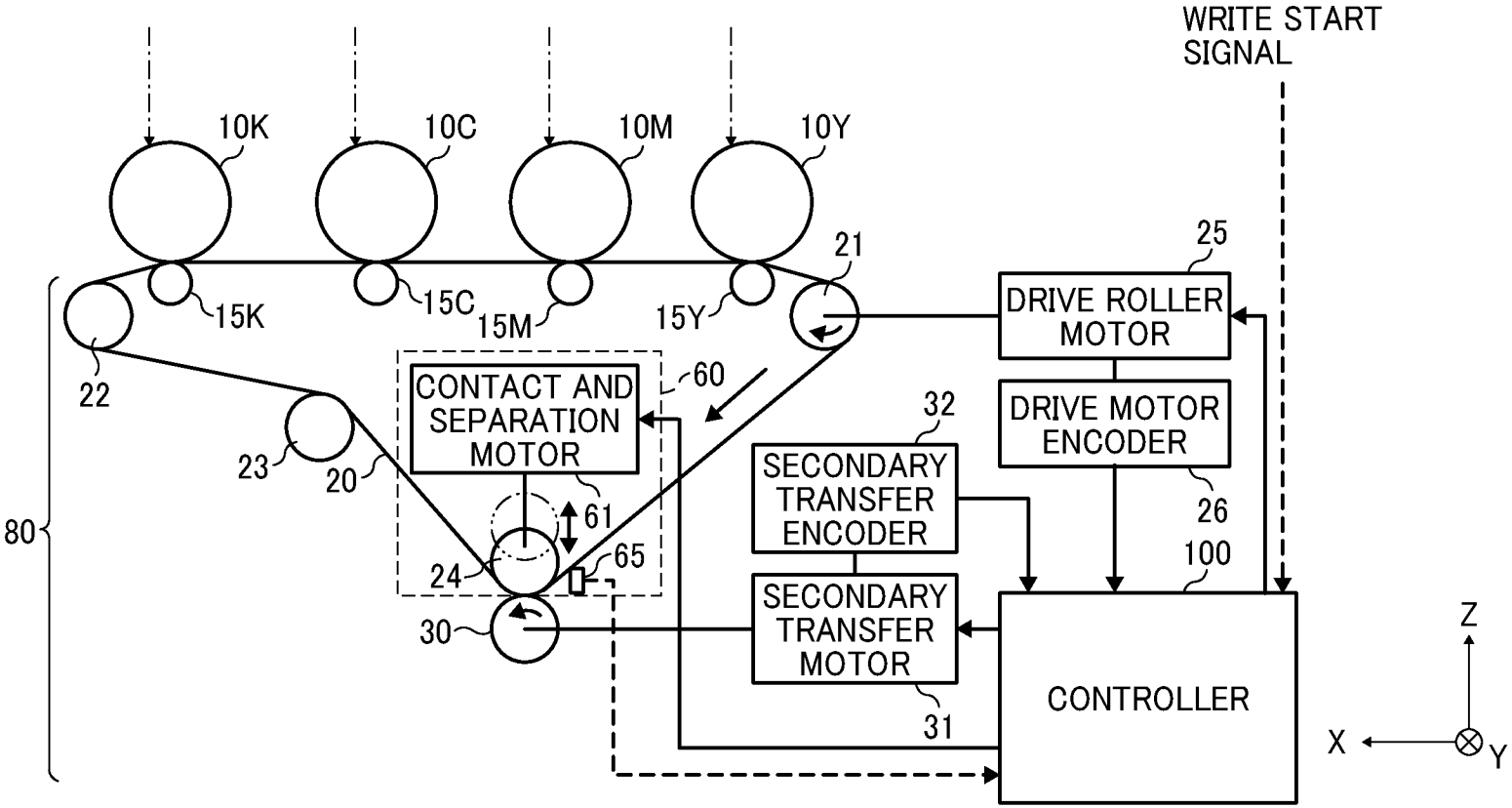
FIG. 2 is a diagram illustrating a configuration of a transfer device including a contact and separation mechanism according to Embodiment 1 of this disclosure.

FIG. 2 is a diagram illustrating a configuration of a sheet conveyor 80 including a contact and separation mechanism 60 according to Embodiment 1 of this disclosure. Specifically, FIG. 2 is a schematic diagram illustrating an example of a configuration of the intermediate transfer belt 20 and the secondary transfer roller 30, and control of the intermediate transfer belt 20 and the secondary transfer roller 30, according to Embodiment 1 of this disclosure.

The intermediate transfer belt 20 is bridged around multiple rollers 21, 22, 23, and 24. The multiple rollers 21, 22, 23, and 24 include a drive roller 21 and an opposing roller 24. The intermediate transfer belt 20 is rotated together with the drive roller 21 that is driven by a drive roller motor 25, in a direction indicated by arrow in FIG. 2.

A controller 100 controls a rotation speed of the drive roller motor 25 with feedback control. According to this configuration, the drive roller 21 is rotated by the drive roller motor 25 at a predetermined rotation speed to rotate the intermediate transfer belt 20.

A drive motor encoder 26 is mounted on a rotary shaft of the drive roller motor 25. The controller 100 can obtain the rotation speed of the drive roller 21 based on a detection result of the drive motor encoder 26.

The intermediate transfer belt 20 is one example of a first rotary body that is disposed between the photoconductor 10 (i.e., the photoconductors 10K, 10C, 10M, and 10Y) and the primary transfer roller 15 (i.e., the primary transfer rollers 15K, 15C, 15M, and 15Y) and that receives a toner image formed on the surface of the photoconductor 10 in the primary transfer nip region. The toner image transferred onto the surface of the intermediate transfer belt 20 is further transferred onto a sheet P in the secondary transfer nip region formed between the intermediate transfer belt 20 and the secondary transfer roller 30.

The secondary transfer roller 30 is one example of a second rotary body that includes a metal cored bar and an elastic material covering the outer circumference of the metal cored bar. The metal cored bar is, for example, a steel use stainless (SUS) and an elastic material is, for example, a urethane member with the resistance value being adjusted by a conductive material. The opposing roller 24 is disposed opposing the secondary transfer roller 30 to move the intermediate transfer belt 20 toward the secondary transfer roller 30, so as to press the sheet P by the intermediate transfer belt 20 and the secondary transfer roller 30. A position in a sheet conveyance passage, at which the intermediate transfer belt 20 and the secondary transfer roller 30 hold the sheet P therebetween is referred to as an opposing region.

Further, the opposing roller 24 is movable between a position at which the intermediate transfer belt 20 is pressed against the secondary transfer roller 30 with the sheet P therebetween and a position at which the intermediate transfer belt 20 is separated from the sheet P. The opposing roller 24 is a part of a secondary transfer portion where the secondary transfer is performed and is also a part of the contact and separation mechanism 60 that brings at least the surface of the intermediate transfer belt 20 that functions as a first rotary body and the secondary transfer roller 30 that functions as a second rotary body into contact with each other and into separation from each other.

The secondary transfer roller 30 is rotated by a secondary transfer motor 31 in a direction indicated by arrow in FIG. 2. The secondary transfer roller 30 is rotated at the predetermined rotation speed by the secondary transfer motor 31 that is controlled by the controller 100 with the feedback control on the rotation speed.

A sheet timing sensor for sheet conveyance is mounted on the sheet conveyance passage.

A secondary transfer encoder 32 is mounted on a rotary shaft of the secondary transfer motor 31. The controller 100 can obtain the rotation speed of the secondary transfer roller 30 based on a detection result of the secondary transfer encoder 32.

A write start signal that instructs the start of writing to the photoconductor 10 is inputted from a main controller 91 of the image forming apparatus 90 (see FIG. 9) to the controller 100. The controller 100 regulates an approach start time, a contact start time, and a separation start time are regulated according to passage of time from assertion of the write start signal. It is to be noted that a signal to trigger such time regulation of the approach start time, the contact start time, and the separation start time is not limited to the write start signal but any signal can be applied to this disclosure as long as the signal indicates the time of conveyance of a sheet P.

The contact and separation mechanism 60 causes the intermediate transfer belt 20 and the secondary transfer roller 30 to contact or separate from each other between the position at which the intermediate transfer belt 20 and the secondary transfer roller 30 are pressed against the sheet P to perform secondary transfer and the position at which the intermediate transfer belt 20 is separated from the sheet P. In a case in which no sheet exists between the intermediate transfer belt 20 and the secondary transfer roller 30, a position where the intermediate transfer belt 20 and the secondary transfer roller 30 are separated from each other with a distance greater than the thickness of the sheet P, which is hereinafter referred to as a "separated position". A position where the intermediate transfer belt 20 and the secondary transfer roller 30 are pressed against the sheet P to perform secondary transfer is hereinafter referred to as a "pressing position".

The contact and separation mechanism 60 includes a contact and separation motor 61, the opposing roller 24, and a home position (HP) sensor 65.

The opposing roller 24 biases the intermediate transfer belt 20 toward the secondary transfer roller 30.

The contact and separation motor 61 drives contact and separation of the opposing roller 24 to perform contact and separation of the intermediate transfer belt 20 with respect to the secondary transfer roller 30. The contact and separation motor 61 is controlled by the controller 100.

The HP sensor 65 outputs a signal when the opposing roller 24 is located at a predetermined position. The contact and separation mechanism 60 is further includes a contact and separation roller 63, which is described below with reference to FIG. 3B.

The controller 100 controls the contact and separation motor 61 based on the output of the HP sensor 65.

Figure 4:
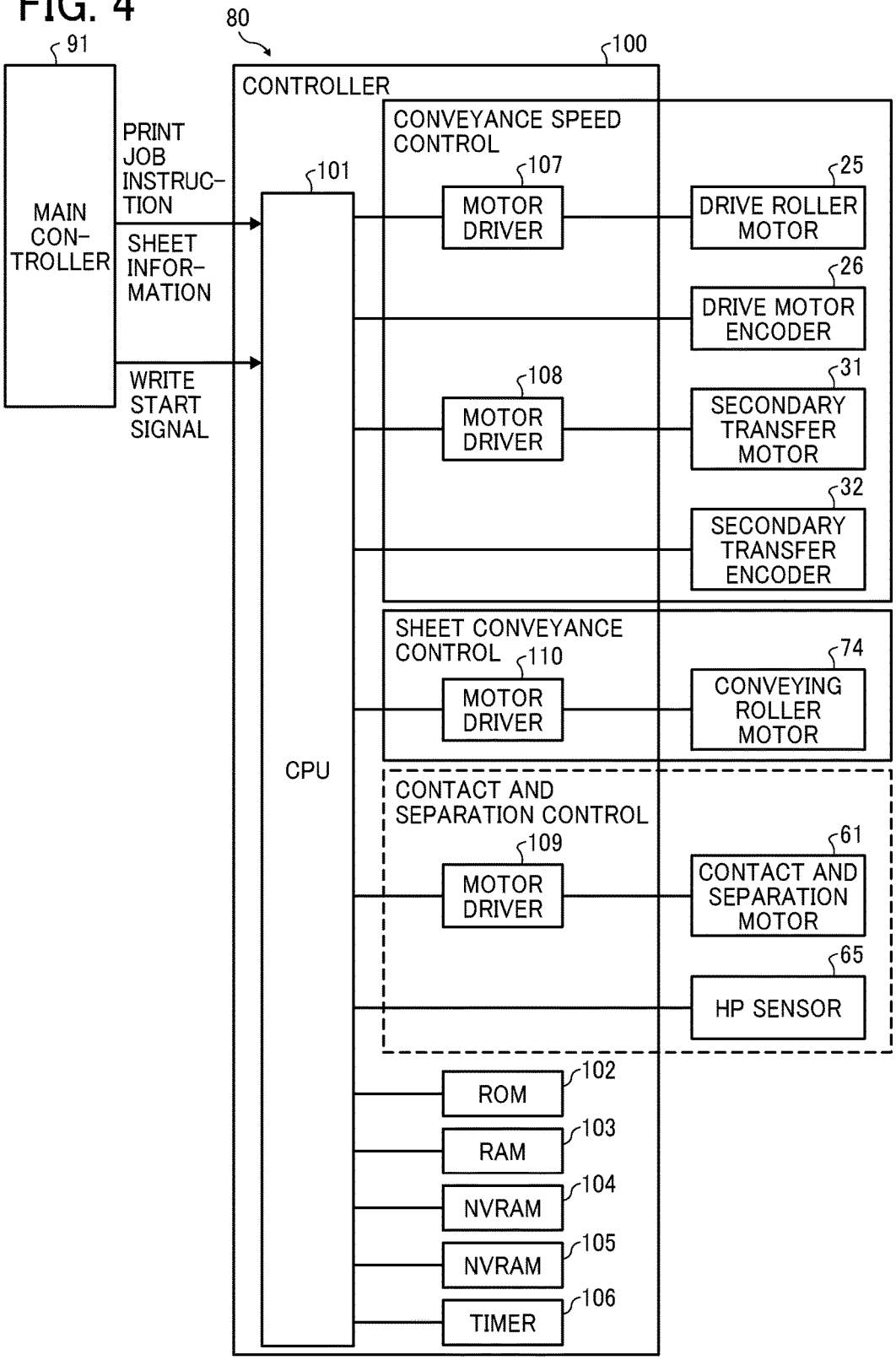
FIG. 4 is a block diagram illustrating a drive control of the transfer device according to Embodiment 1 of this disclosure.

The controller 100 further includes memories that function as data storing devices (for example, nonvolatile random access memories (NVRAMs) 104 and 105 illustrated in FIG. 4). The controller 100 controls the rotation speed and the conveying speed of the secondary transfer motor 31 based on data stored in the memory (i.e., the NVRAM 104), the position of the opposing roller 24 of the contact and separation mechanism 60 based on the data stored in the memory (i.e., the NVRAM 105), and the position of the intermediate transfer belt 20 to the secondary transfer roller 30.

Now, a description is given of the contact and separation mechanism 60 of the image forming apparatus 90.

Example of Configuration of Contact and Separation Mechanism.

Figure 3A:
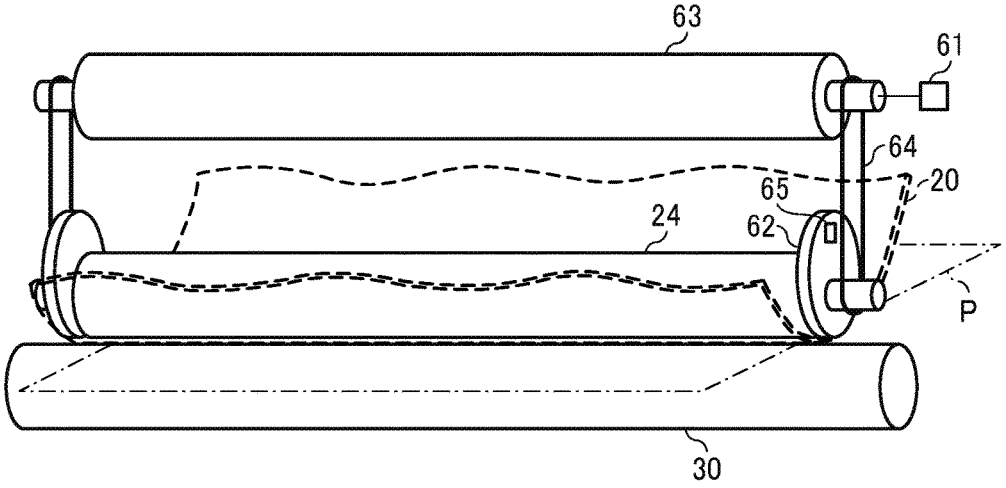
FIGS. 3A and 3B are diagrams illustrating a configuration of the contact and separation mechanism according to Embodiment 1 of this disclosure.
Figure 3B:
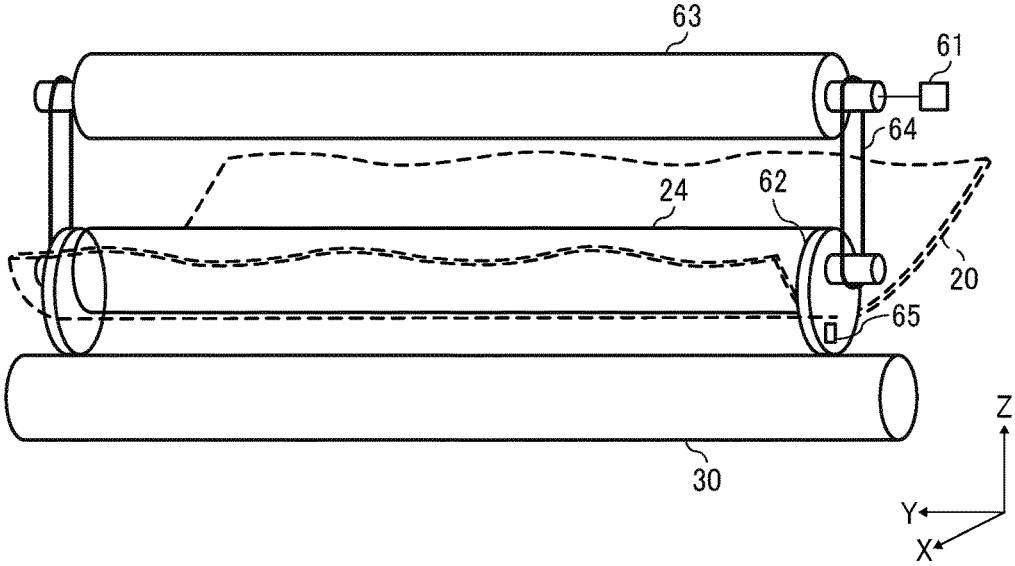

FIGS. 3A and 3B are diagrams illustrating a configuration of the contact and separation mechanism 60 according to Embodiment 1 of this disclosure. Specifically, FIG. 3A is a diagram illustrating a state in which the opposing roller 24 moves toward the secondary transfer roller 30 and therefore the intermediate transfer belt 20 is in contact with the secondary transfer roller 30. FIG. 3B is a diagram illustrating a state in which the opposing roller 24 moves away from the secondary transfer roller 30 and therefore the intermediate transfer belt 20 is separated from the secondary transfer roller 30.

The opposing roller 24 is biased by an elastic body such as a spring, toward the secondary transfer roller 30. As illustrated in FIGS. 3A and 3B, an eccentric cam 62 is mounted on a rotary shaft of the opposing roller 24. The contact and separation motor 61 is coupled to the eccentric cam 62 via a belt 64. As the contact and separation motor 61 rotates, the intermediate transfer belt 20 and the secondary transfer roller 30 contact each other or separate from each other, via the opposing roller 24.

For example, as illustrated in FIG. 3A, an eccentric cam 62 is mounted on a rotary shaft of the opposing roller 24. The contact and separation motor 61 is coupled to the eccentric cam 62 via a belt 64. As the contact and separation motor 61 drives to rotate the contact and separation roller 63, the eccentric cam 62 rotates together with the contact and separation roller 63 via the belt 64. Accordingly, the eccentric cam 62 is set to a predetermined angle of rotation, at which the opposing roller 24 is moved to an approaching direction, and the intermediate transfer belt 20 contacts the secondary transfer roller 30.

Further, as illustrated in FIG. 3B, the contact and separation roller 63 that is rotated by the contact and separation motor 61 rotates the eccentric cam 62 that is coupled to the opposing roller 24 via the belt 64. Accordingly, the eccentric cam 62 is set to another predetermined angle, at which the opposing roller 24 and the secondary transfer roller 30 separate from each other.

As illustrated in FIGS. 3A and 3B, the HP sensor 65 is mounted on a part of the eccentric cam 62, for example. The HP sensor 65 detects that the eccentric cam 62 is at a predetermined angle of rotation. This detection by the HP sensor 65 indicates that the opposing roller 24 is located at a predetermined position.

The position of the intermediate transfer belt 20 to the secondary transfer roller 30 is obtained by the controller 100 based on an amount of rotation of the contact and separation motor 61, according to the detection result of the HP sensor 65.

It is to be noted that the secondary transfer roller 30, the contact and separation roller 63 included in the contact and separation mechanism 60 of FIGS. 3A and 3B, and the opposing roller 24 included in the contact and separation mechanism 60 of FIGS. 3A and 3B are general tubular or cylindrical rollers having an outer circumference of a circular shape or a substantially circular shape.

Next, a description is given of a configuration of the controller 100 of the sheet conveyor 80 that functions as a material conveyor.

Drive Control Block.

FIG. 4 is a block diagram illustrating a drive control of the sheet conveyor 80 according to Embodiment 1 of this disclosure.

As illustrated in FIG. 4, a secondary transfer device, which is an example of the sheet conveyor 80 that performs contact and separation operations, performs drive control and includes the controller 100, the drive roller motor 25, the drive motor encoder 26, the secondary transfer motor 31, the secondary transfer encoder 32, the contact and separation motor 61, and the HP sensor 65. The controller 100 is a control board including a central processing unit (CPU) and a field-programmable gate array (FPGA).

The drive roller motor 25 is a motor to convey a sheet P that functions as a transfer target material and drives to rotate the drive roller 21 (see FIG. 2) that rotates the intermediate transfer belt 20. Further, the rotation speed of the drive roller motor 25 and the moving speed of the intermediate transfer belt 20 can be obtained based on the detection results of the drive motor encoder 26.

It is to be noted that the drive roller 21 may be controlled based on the moving speed of the intermediate transfer belt 20 that is detected by a scale sensor that detects a belt scale provided to the intermediate transfer belt 20.

A conveying roller motor 74 is a motor to feed and convey the sheet P that functions as a transfer target material. The conveying roller motor 74 drives the sheet feed roller 72 (see FIG. 1) to convey the sheet P.

The secondary transfer motor 31 drives to rotate the secondary transfer roller 30. Further, the rotation speed of the secondary transfer roller 30 can be obtained based on the detection result of the secondary transfer encoder 32.

The contact and separation motor 61 is an example of a moving and driving device that moves the opposing roller 24 to contact or separate from the secondary transfer roller 30.

It is preferable that the drive roller motor 25, the secondary transfer motor 31, and the contact and separation motor 61 are stepping motors (STMs).

Figure 5:
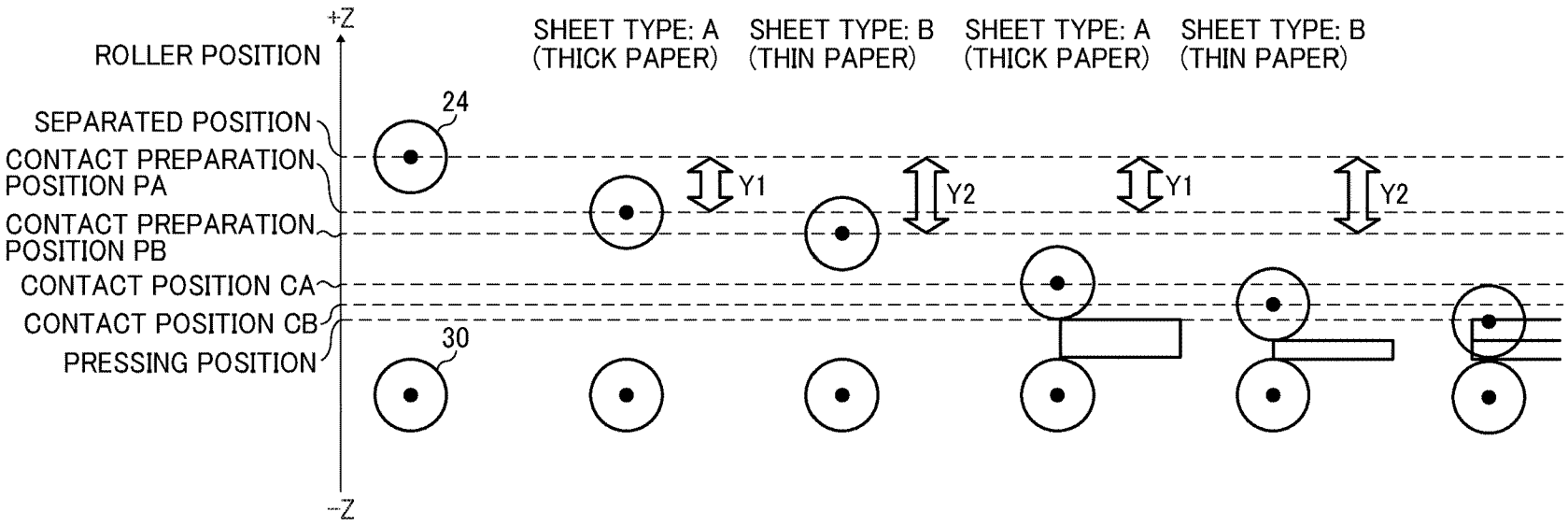
FIG. 5 is a diagram illustrating a positional relation of a separated position, contact preparation positions, contact positions, and a pressing position of an opposing roller and a secondary transfer roller.

The HP sensor 65 is an example of a position detecting sensor that functions as a position detector. As illustrated in FIG. 5, the HP sensor 65 outputs a predetermined signal when the opposing roller 24 is located at a predetermined position that is a reference of the approaching direction and a separation direction of the contact and separation mechanism 60.

The controller 100 includes a central processing unit (CPU) 101, a read only memory (ROM) 102, a random access memory (RAM) 103, nonvolatile random access memories (NVRAMs) 104 and 105, a timer 106, and motor drivers 107, 108, 109, and 110.

The CPU 101 controls sheet conveyance while grasping the status of rotation of the drive roller 21 by the drive motor encoder 26 and the secondary transfer roller 30 by the secondary transfer encoder 32. At the same time, the CPU 101 controls the contact and separation operations using the detection result of the HP sensor 65.

The ROM 102 stores programs written by codes readable by the CPU 101 and various data used for executing the program.

The RAM 103 is a working memory for the CPU 101. For example, the RAM103 expands contact and separation information in response to a request from the CPU 101.

The timer 106 measures a predetermined time such as a temporary stop time Ma and a pressing time La.

The motor driver 107 controls the drive roller motor 25 according to print job instruction.

The motor driver 108 controls the secondary transfer motor 31.

The motor driver 109 causes the contact and separation motor 61 to rotate according to the state in which a sheet approaches the opposing region, so that the opposing roller 24 moves with a predetermined speed and a predetermined orientation.

For example, the contact and separation motor 61 that functions as a stepping motor has the previously set number of pulses per rotation of the contact and separation motor 61 and the previously set unit multiplier. With the settings, an "amount of movement per pulse" is previously set to correspond to an amount of movement of the opposing roller 24 per pulse of the shaft of the contact and separation motor 61, so as to be controlled by the motor driver 109.

Alternatively, the motor driver 109 may control an "amount of movement per rotation" that corresponds to an amount of movement of the opposing roller 24 per rotation of the shaft of the contact and separation motor 61.

The motor driver 110 drives and controls the conveying roller motor 74.

The NVRAM 104 is a memory for sheet transfer and conveyance and previously stores transfer conditions and the conveying speed of a belt such as the intermediate transfer belt 20.

The NVRAM 105 is a memory for contact and separation operations and previously stores information of various types of pressing times La, approaching speeds V1, contacting speeds V2, approach amounts Y1, separating speeds V3, temporary stop times Ma according to types of transfer target materials.

It is to be noted that the NVRAM 105 may not include the entire information but may include information sufficient to perform the contact and separation operations, described below, preferably.

Further, the above-described information may be reserved according to the conveying speed of a transfer target material and the conveying speed of the intermediate transfer belt 20 additionally.

It is to be noted that the approach amount Y1 is any or an arbitrary position between the separated position and the pressing position and corresponds to a specified movement amount that is corresponded to any or an arbitrary distance to a contact preparation position at which the intermediate transfer belt 20 and the secondary transfer roller 30 are separated from each other (see FIG. 5). For example, the specified movement amount is set by specifying the pulse, the unit multiplier, and the amount of rotation to the contact and separation motor 61.

The pressing time La indicates a period of time in which the opposing roller 24 is located at the pressing position.

The above-described information can be obtained in response to request by the CPU 101 and access to the NVRAMs 104 and 105.

It is to be noted that the CPU 101 is illustrated as a single unit as a main controller 91 in FIG. 4 but may be separate units as a sheet conveyance controller and a contact and separation controller.

Position of the Intermediate Transfer Belt.

FIG. 5 is a diagram illustrating positional relations of a separated position, contact preparation positions, contact positions, and a pressing position of the opposing roller 24 and the secondary transfer roller 30.

In FIG. 5, state (a) of FIG. 5 indicates a predetermined separated position of the opposing roller 24, state (b) of FIG. 5 indicates a contact preparation position PA for thick papers, state (c) of FIG. 5 indicates a contact preparation position PB for thin papers, state (d) of FIG. 5 indicates a contact position CA for thick papers, state (e) of FIG. 5 indicates a contact position CB for thin papers, and state (f) of FIG. 5 indicates a pressing position.

It is to be noted that a description with reference to FIG. 5 is given of the position of the opposing roller 24 that functions as the contact and separation mechanism 60 of the intermediate transfer belt 20 that functions as a first rotary body.

It is also to be noted that an approaching action in which the opposing roller 24 approaches the secondary transfer roller 30 and a pressing action that is movement of the opposing roller 24 to increase the contact pressure of the intermediate transfer belt 20 and the sheet P and the contact pressure of the secondary transfer roller 30 and the sheet P by further moving toward the secondary transfer roller 30 are collectively referred to as "movement to the approaching direction".

The HP sensor 65 outputs a signal when the opposing roller 24 is located at a predetermined position detected by the HP sensor 65. The detection signal is output, for example, when the signal is asserted, becomes to an H level, or becomes active.

A contact preparation position PA illustrated in the state (b) of FIG. 5 and a contact preparation position PB illustrated in the state (c) of FIG. 5 indicate respective speed switching positions, at each of which the speed of the opposing roller 24 changes from a first moving speed to a second moving speed in the contact and separation mechanism 60.

A contact preparation position is any or an arbitrary position separated from a predetermined separated position by any or an arbitrary distance and is regulated by specified movement amounts (i.e., the approach amount Y1 and an approach amount Y2 in FIGS. 8A and 8B) that are set by changing according to the type and conveying speed of the sheet P that functions as a transfer target material.

In addition, as described above, the contact preparation position is a position at which the intermediate transfer belt 20 and the secondary transfer roller 30 are separated from each other.

A contact position CA illustrated in the state (d) of FIG. 5 and a contact position CB illustrated in the state (e) of FIG. 5 indicate respective positions, at each of which the opposing roller 24 starts to contact the sheet P (of the sheet type A or of the sheet type B) or to separate from the sheet P. The contact position varies depending on the thickness of the sheet P. A contact pressure of the intermediate transfer belt 20 and the secondary transfer roller 30 to the sheet P is relatively low at the contact position.

The pressing position illustrated in the state (f) of FIG. 5 is a position in a state in which an image is ready to be transferred and in which the intermediate transfer belt 20 and the secondary transfer roller 30 are in contact with each other with a predetermined pressure.

The state (f) of FIG. 5 illustrates an example with the sheet type B (thin papers).

At the pressing position illustrated in the state (f) of FIG. 5, the intermediate transfer belt 20 is pressed against the secondary transfer roller 30 farther than the contact position CA in the state (d) of FIG. 5 and the contact position CB in the state (e) of FIG. 5. In other words, the pressing position of the state (f) of FIG. 5 is greater in contact pressure than the contact position CA in the state (d) of FIG. 5 and the contact position CB in the state (e) of FIG. 5. Accordingly, the pressing position can be adjusted to obtain a desired transfer pressure. There may be a case in which a sheet P having the sheet type A (i.e., a thick paper) comes to a pressing position less pressed than a sheet P having the sheet type B. However, there may be thick papers of some types that are not pressed.

Position Control in Contact and Separation Operations.

Figure 6:
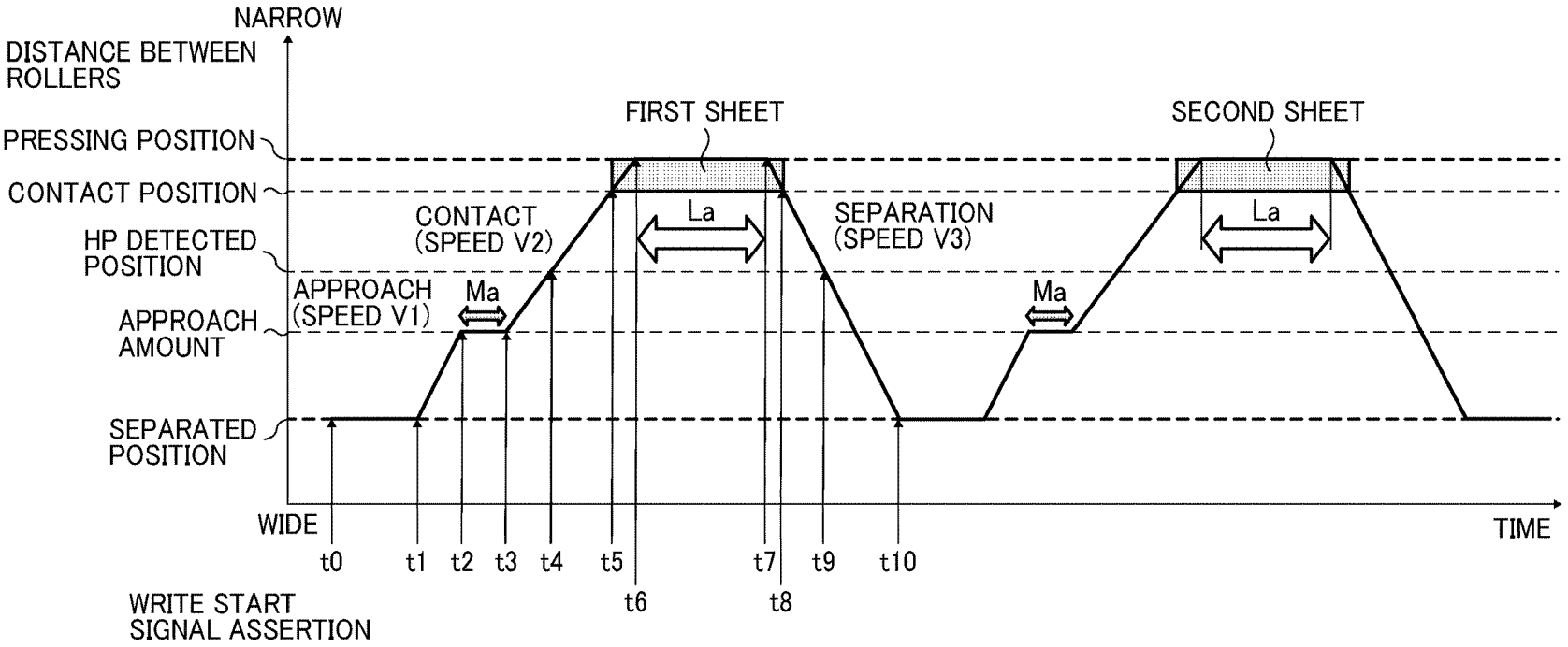
FIG. 6 is a timing chart illustrating positions of two rotary bodies in movement of contact and separation when sheets are conveyed sequentially.
Figure 7A:
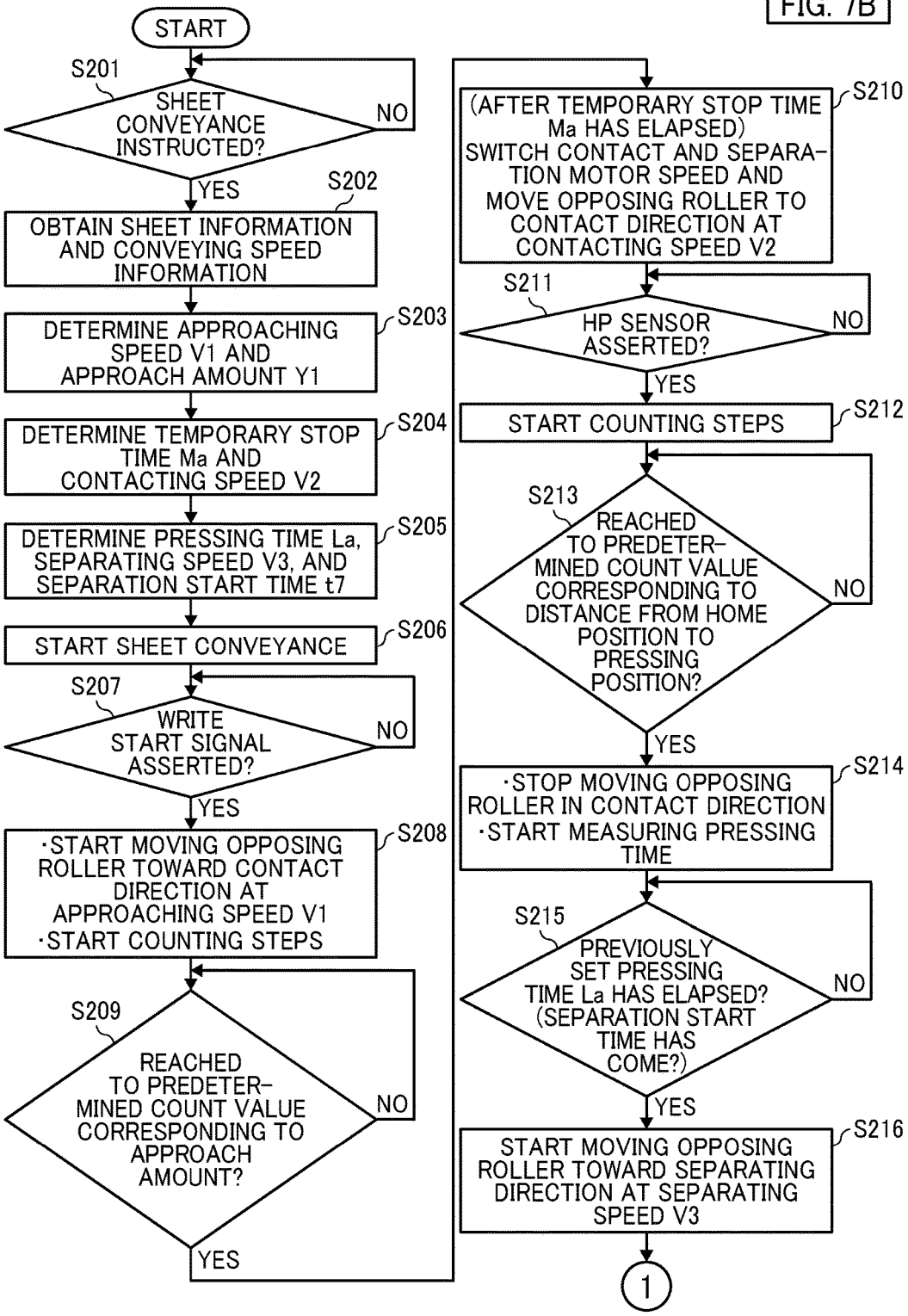
FIG. 7, which is divided into two sheets of FIG. 7A and FIG. 7B, is a flowchart illustrating a control flow in the transfer device according to Embodiment 1 of this disclosure.
Figure 7B:
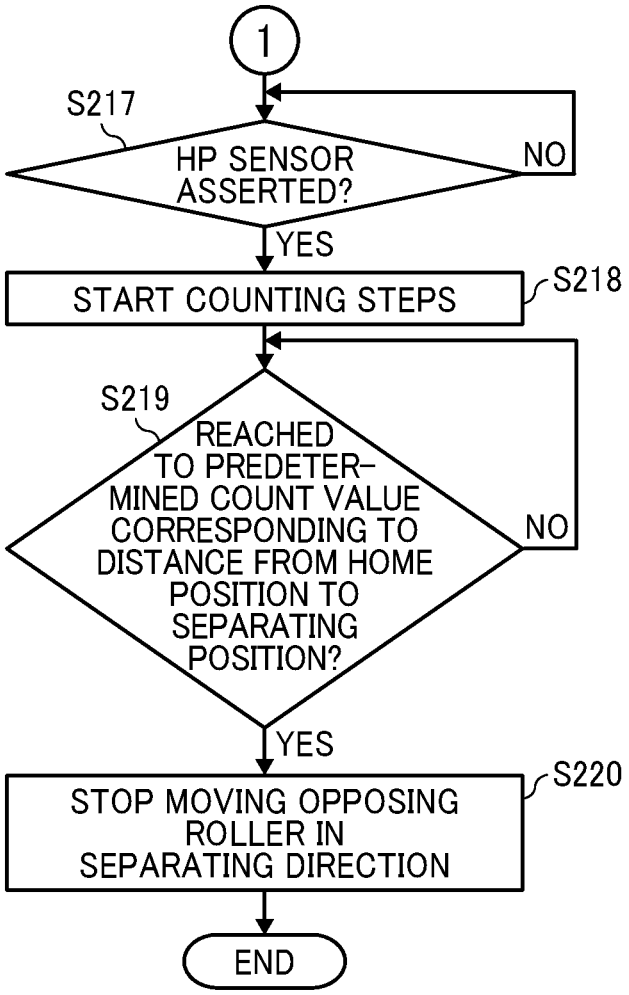

FIG. 6 is a timing chart illustrating the positional relation of respective surfaces of two rotary bodies in the contact and separation operations when sheets are conveyed sequentially. FIG. 7, which is divided into two sheets of FIG. 7A and FIG. 7B, is a flowchart illustrating a control flow in the sheet conveyor 80 according to Embodiment 1 of this disclosure.

A description is given of a control of the contact and separation operations of the rotary bodies in the sheet conveyor 80 according to Embodiment 1 of this disclosure, with reference to FIGS. 6 and 7.

It is to be noted that the opposing roller 24 functions as a mechanism that moves while biasing the intermediate transfer belt 20 that functions as a first rotary body, and therefore the position of the surface of the intermediate transfer belt 20 is occasionally referred to as the position of the opposing roller 24.

In addition, the vertical axis in FIG. 6 indicates a distance between rotary bodies. Therefore, as the vertical axis moves upward, the distance between rotary bodies becomes short or small, and the distance becomes shortest or smallest at the pressing position.

As a premise, the intermediate transfer belt 20 and the secondary transfer roller 30 that function as two rotary bodies remain separated from each other while no sheet is conveyed in the sheet conveyor 80.

In step S201 in the flowchart of FIG. 7, the controller 100 determines whether or not a sheet conveyance instruction to convey a sheet is obtained. For example, the sheet conveyance instruction indicates that a print job instruction has been issued from the main controller 91 to the controller 100.

When the sheet conveyance instruction is not obtained (NO in step S201), the process of step S201 is repeated until the sheet conveyance instruction is obtained.

When the sheet conveyance instruction is obtained (YES in step S201), the controller 100 obtains sheet information and conveying speed information from the main controller 91, in step S202.

In step S203 in the flowchart of FIG. 7, the controller 100 reads the approaching speed V1 and the approach amount Y1, which are associated with the sheet information and the conveying speed information and stored in the NVRAM 105 according to the sheet information and the conveying speed information obtained in step S202 and sets the values based on these parameters.

In step S204 in the flowchart of FIG. 7, the controller 100 determines the temporary stop time Ma at the contact preparation position that corresponds to the speed switching position and the contacting speed V2 according to the sheet information and the conveying speed information obtained in step S202 and the approaching speed V1 and the approach amount Y1 obtained in step S203.

In this speed setting, the contacting speed V2 is set to establish an inequality of "Approaching Speed (First Speed) V1>Contacting Speed (Second Speed) V2".

Here, the approaching speed V and the contacting speed V2 are movement speeds, each of which is generated by driving the contact and separation motor 61 that is a stepping motor at a frequency smaller than the maximum self-starting frequency fs. Both the approaching speed V1 and the contacting speed V2 start, move, and stop at a constant speed without considering acceleration and deceleration.

In step S205, the controller 100 determines the pressing time La, the separating speed V3, and a separation start time t7 according to the sheet information and the conveying speed information obtained in step S202, the approaching speed V1 and the approach amount Y1 set in step S203, and the temporary stop time Ma and the contacting speed V2 at the speed switching position set in step S204.

In step S206, the controller 100 causes the sheet feed roller 72 (see FIG. 1) to rotate based on the conveying speed information to start sheet conveyance. In addition, the controller 100 causes the drive roller 21 to rotate based on the conveying speed information to start rotating the intermediate transfer belt 20.

In step S207, the controller 100 determines whether or not the write start signal is asserted. When the write start signal is not asserted, in other words, is not turned on (NO in step S207), the process of step S207 is repeated until the write start signal is asserted. When the write start signal is asserted, in other words, is turned on (YES in step S207), this detection triggers the action in step S208. Specifically, in step S208, the controller 100 starts driving the contact and separation motor 61 to move the opposing roller 24 in the approaching direction at a set time with the approaching speed V1, so as to start counting steps of the contact and separation motor 61.

A time of performance in step S207 in the flowchart of FIG. 7 corresponds to a time t0 in FIG. 6 and a time of performance in step S208 in the flowchart of FIG. 7 corresponds to a time t in FIG. 6.

In step S209, the controller 100 determines whether or not the step of the contact and separation motor 61 has reached a predetermined count value that corresponds to the approach amount Y1. When the step of the contact and separation motor 61 has not reached the predetermined count value that corresponds to the approach amount Y1 (NO in step S209), the process of step S209 is repeated until the step of the contact and separation motor 61 reaches the predetermined count value. When the step of the contact and separation motor 61 has reached the predetermined count value that corresponds to the approach amount Y1 (YES in step S209 in FIG. 7 and a time t2 in FIG. 6), the controller 100 switches the moving speed of the opposing roller 24 driven by the contact and separation motor 61 to the contacting speed V2 in step S210 (a time t3 in FIG. 6). For example, by reducing the operating frequency of a stepping motor that is the contact and separation motor 61 to slow down the rotation speed of the contact and separation motor 61, the moving speed of the opposing roller 24 to the approaching direction decreases.

It is to be noted that, when the temporary stop time Ma exists in step S204, the moving speed of the contact and separation motor 61 is switched to the contacting speed V2 after the set temporary stop time Ma has elapsed in step S210. The timing chart of FIG. 6 indicates an example that the temporary stop time Ma is set but it is not limited to this example. For example, when the conveying speed becomes faster (e.g., the conveying speed is equal to or greater or faster than a predetermined threshold), the contact and separation operations can be executed in a shorter period of time. Therefore, a temporary stop time can be omitted between the time t0 and the time t1 or between the time t2 and the time t3, for example.

When the conveying speed is faster, the detection time (step S207) at the write start signal may be equal to a movement start time (step S208) in the approaching direction (the time t0=the time t1).

Immediately after the step of the contact and separation motor 61 has reached the predetermined count value, that is, immediately after the opposing roller 24 has moved to the contact preparation position that is an arbitrary position, at the first speed (step S209), the controller 100 may switch the moving speed of the opposing roller 24 to the second speed to move in the approaching direction (the time t2=the time t3).

The contact and separation motor 61 rotates to the predetermined position to move the opposing roller 24 to the approaching direction. Then, the controller 100 determines whether or not the HP sensor 65 is asserted in step S211. When the HP sensor 65 is not asserted (NO in step S211), the process of step S211 is repeated until assertion of the HP sensor 65 is detected. When the HP sensor 65 becomes asserted (YES in step S211), the controller 100 starts counting the number of steps of the contact and separation motor 61 in step S212 in the flowchart of FIG. 7 corresponding to a time t4 in FIG. 6.

Then, the controller 100 determines whether or not the number of steps of the contact and separation motor 61 has reached a predetermined number of counts corresponding to a distance from a detected position of the HP sensor 65 to the pressing position in step S213. When the number of steps of the contact and separation motor 61 has not reached the predetermined number of counts corresponding to the distance from the detected position of the HP sensor 65 to the pressing position (NO in step S213), the process of step S213 is repeated until the number of steps of the contact and separation motor 61 has reached the predetermined number of counts (YES in step S213), the controller 100 stops the contact and separation motor 61 to the movement of the opposing roller 24 to the approaching direction and starts measuring the pressing time La in step S214 in the flowchart of FIG. 7 corresponding to a time t6 in FIG. 6.

It is to be noted that, as illustrated in FIG. 6, the opposing roller 24 reaches the contact position before reaching the pressing position. The contact position is a position at which the sheet P on the secondary transfer roller 30 and the surface of the intermediate transfer belt 20 that is wound around the opposing roller 24 contact each other. At the same time that the leading end of the sheet P reaches the opposing region, i.e., in synchronization with arrival of the leading end of the material to the opposing region, the opposing roller 24 reaches the contact position. Then, in the opposing region, the intermediate transfer belt 20 and the secondary transfer roller 30 start contacting the sheet P (a time t5 in FIG. 6).

The contact pressure between the intermediate transfer belt 20 and the secondary transfer roller 30 gradually increases from the time at which the sheet P reaches the opposing region, and the opposing roller 24 reaches the pressing position (the time t6 in FIG. 6). An image is transferred from the intermediate transfer belt 20 onto the sheet P in a state in which the opposing roller 24 is located at the pressing position. It is to be noted that the opposing roller 24 moves from the contact position to the pressing position in a relatively short period of time, that is, within a period of time in which the sheet P is conveyed from the leading end to a location some mm away from the leading end (the time t6 in FIG. 6).

Then, the controller 100 determines whether or not the pressing time La previously set has elapsed to reach the separation start time t7 (i.e., the time t7 in FIG. 6) in step S215. When the pressing time La has not elapsed to reach the separation start time t6 (NO in step S215), the process of step S215 is repeated until the pressing time La elapses to reach the separation start time t7. When pressing time La has elapsed to reach the separation start time t7 (YES in step S215), the controller 100 drives the contact and separation motor 61 to start moving the opposing roller 24 to a separation direction at the separating speed V3 in step S216.

Here, FIG. 6 indicates the timing chart of an example for conveyance of a thick paper, indicating that the opposing roller 24 leaves from the contact position at the same time the trailing end of the sheet P moves from the opposing region (a time t8).

After the contact and separation motor 61 rotates to the predetermined position in order to move the opposing roller 24 to the separation direction, the controller 100 determines whether or not the HP sensor 65 is asserted in step S217. When the HP sensor 65 has not been asserted (NO in step S217), the process of step S217 is repeated until acknowledge of assertion of the HP sensor 65. When the HP sensor 65 has been asserted (YES in step S217), the controller 100 counts the number of steps to the separated position in step S218 in the flowchart of FIG. 7 corresponding to a time t9 in FIG. 6.

Then, the controller 100 determines whether or not the number of steps of the contact and separation motor 61 has reached a predetermined number of counts corresponding to a distance from the detected position of the HP sensor 65 to the separated position in step S219. When the number of steps of the contact and separation motor 61 has not reached the predetermined number of counts corresponding to the distance from the detected position of the HP sensor 65 to the separated position (NO in step S219), the process of step S219 is repeated until the number of steps of the contact and separation motor 61 reaches the predetermined number of counts. When the number of steps of the contact and separation motor 61 has reached the predetermined number of counts (YES in step S219), the controller 100 stops the contact and separation motor 61 to cause the movement of the opposing roller 24 to stop in the separation direction of the opposing roller 24 in step S220 in the flowchart of FIG. 7 corresponding to a time t10 in FIG. 6.

After completion of the movement of the opposing roller 24 to the separated position, the flow of the control of the contact and separation operations ends.

In a case of a print job of multiple sheets P or in a case in which multiple sheets P sequentially pass the opposing region, the above-described flow of control of the contact and separation operations is repeated, as illustrated in FIG. 6.

By performing the above-described flow of control of the contact and separation operations, the approaching action is performed to move by the amount of the approach amount Y1 at the approaching speed V1 in steps S208 and S209. By so doing, the two rotary bodies quickly approach each other to a position near the pressing position before the sheet P enters between the two rotary bodies. Then, in steps S210 through S213, the contacting speed V2 during the period of time in which the distance of the two rotary bodies is decreased can be slower, and therefore this action can contribute to a reduction in shock jitters during conveyance of the sheet P.

It is to be noted that the above-described flow indicates the control of the contact and separation operations of the two rotary bodies in regular printing. However, in a case of recovery from error and power ON or of resetting, the HP sensor 65 is used to return the two rotary bodies to the separated position. For example, even if the relative position of the opposing roller 24 is lost, the opposing roller 24 is moved from the current position in the approaching direction or in the separation direction so that the HP sensor 65 can detect the home position of the opposing roller 24. On arrival of the opposing roller 24 to the home position, the opposing roller 24 is moved to the separation direction. By using a predetermined count value that corresponds to a predetermined distance from the home position to the separated position, the opposing roller 24 can return to the separated position.

Adjustment Based on Difference of Sheet Thickness.

FIGS. 8A and 8B are timing charts illustrating positions of the two rotary bodies in the contact and separation operations when materials, including sheets for example, having different thicknesses from each other are conveyed. Specifically, FIG. 8A illustrates an example of the contact and separation operations when the sheet P belongs to sheet type A of thick papers and FIG. 8B illustrates an example of the contact and separation operations when the sheet P belongs to sheet type B of thin papers.

The vertical axes in FIGS. 8A and 8B are same as the vertical axis in FIG. 6. FIGS. 8A and 8B are also the same as FIG. 6 in indicating the movements with the positions of the opposing roller 24 that biases the intermediate transfer belt 20 that functions as a first rotary body.

In the following description, a sheet thickness of sheet type A is indicated as sheet thickness Ta and a sheet thickness of sheet type B is indicated as sheet thickness Tb. That is, a sheet P of sheet type A is thicker than a sheet P of sheet type B, indicated by inequality as "Ta>Tb".

Arrival times to the contact preparation position (i.e., the time t2 and a time t12), start times from the contact preparation position at the contacting speed V2 (i.e., the time t3 and a time t13), the approach amounts (i.e., the approach amounts Y1 and Y2), and the temporary stop times (i.e., the temporary stop times Ma and Mb) are different according to sheet thickness. At the contacting speed V2, the time t13 is faster than the time t3. The approach amount Y1 is less than the approach amount Y2 (Y1<Y2). The arrival times to the contact preparation position (i.e., the times t2 and t12), the moving start times (i.e., the times t3 and t13), and the approach amounts (i.e., the approach amounts Y1 and Y2) are different according to a distance from the contact preparation position to the pressing position.

Generally, as the contacting speed V2 is slower, smaller impact is given to other members, and therefore the shock jitters are more reduced. However, the shorter period of time to approach is preferably taken in order to enhance the conveying speed of the sheet P. Accordingly, the approaching action is made in two steps and makes the approaching speed V1 is faster than the contacting speed V2. By so doing, the contacting speed V2 can be slower, and therefore the conveyance efficiency can be enhanced and shock jitters can be reduced.

As illustrated in FIGS. 8A and 8B, a time to arrive the pressing position and a time to start separation from the pressing position are different according to sheet thickness.

The controller 100 controls the contact and separation mechanism 60 such that the opposing roller 24 arrives the contact position (i.e., the contact positions CA and CB) at the same time that the leading end of the sheet P reaches and starts entering the opposing region, i.e., the time t5, as illustrated in FIGS. 8A and 8B.

Then, when a thick paper is conveyed as illustrated in FIG. 8A, the controller 100 controls the contact and separation mechanism 60 such that the opposing roller 24 arrives the pressing position after the leading end of the sheet P has reached and started entering the opposing region, i.e., the time t6.

When a thin paper is conveyed as illustrated in FIG. 8B, the controller 100 also controls the contact and separation mechanism 60 such that the opposing roller 24 arrives the pressing position after the leading end of the sheet P has reached and started entering the opposing region, i.e., a time t16.

It is to be noted that, when the sheet P is extremely thin, it may be likely that a time the sheet P arrives the opposing region and a time the opposing roller 24 arrives the pressing position are substantially simultaneous.

Generally, when the distance between rotary bodies are narrow and the contact pressure is high at the pressing position, for example, when the position of the opposing roller 24 is close to the secondary transfer roller 30 and the intermediate transfer belt 20 is pressed against the secondary transfer roller 30 more firmly, it is more likely to cause shock jitters due to entrance of a sheet to the opposing region.

In this disclosure, when the leading end of the sheet P enters the opposing region, the position of the surface of the intermediate transfer belt 20 is located farther from the pressing position and the contact pressure is reduced. That is, the opposing roller 24 is moved such that the intermediate transfer belt 20 starts contacting the sheet P at the same time the sheet P is inserted into the opposing region. Thereafter, the opposing roller 24 is moved to the pressing position. Accordingly, shock jitters generated when the sheet P enters the opposing region can be reduced.

By contrast, after the sheet P has entered the opposing region, when the opposing roller 24 is moved from a non-contact state and the intermediate transfer belt 20 is pressed against the sheet P, shock jitters may be generated due to impact of the contact of the intermediate transfer belt 20 and the sheet P.

In order to address this inconvenience, in this disclosure, at the same time the entrance of the sheet P to the opposing region, the sheet P starts to contact the intermediate transfer belt 20 at a lower contact pressure, so that the sheet P is gradually pressed against the intermediate transfer belt 20 at the contacting speed V2 that is a relatively low speed. Therefore, occurrence of shock jitters generated after entrance of the sheet P to the opposing region can be reduced.

As described above, in this disclosure, a shift of a sheet from a contact state to a pressing state is performed at a relatively low speed, and therefore shock jitters generated due to entrance of a transfer target material to the opposing region can be reduced.

In a case of sheet separation, the separating speed V3 of the sheet P of a thick paper having the thickness Ta is set to start at the separation start time t7 and the separating speed V4 of the sheet P of a thin paper having the thickness Tb is set to start at a separation start time t17. With these settings, when the thickness Ta is greater than the thickness Tb (Ta>Tb), the separation start time t17 is faster than the time t7 and the relation of the separating speeds V3 and V4 of the two rotary bodies is expressed as V3>V4, indicating that the separating speed V3 is greater than the separating speed V4.

Specifically, in a case in which the sheet P is a thick paper as illustrated in FIG. 8A, the controller 100 controls the contact and separation mechanism 60 such that the opposing roller 24 starts movement from the pressing position to the separated position earlier than a time at which the trailing end of the sheet P is fed out from the opposing region (the separation start time t7). Then, at a substantially same time as the opposing roller 24 separates the intermediate transfer belt 20 from the contact position (a time t8'), the trailing end of the sheet P is separated from the opposing region (the time t8).

By contrast, in a case in which the sheet P is a thin paper as illustrated in FIG. 8B, the controller 100 controls the contact and separation mechanism 60 such that the opposing roller 24 starts the movement from the pressing position to the separated position (the separation start time t17) earlier than the time at which the trailing end of the sheet P is fed out from the opposing region (the time t8) and further earlier than the case in which the sheet P is a thick paper. Then, the trailing end of the sheet P is separated from the opposing region (the time t8) later than the time at which the opposing roller 24 starts to move from the contact position to the separated position (a time t18).

When the sheet P is a thin paper, the movement start time to the separated position is set to be earlier and the separation speed is set to slower. By slowing down the separation speeds of the two rotary bodies in separation, attachment of the sheet P to the secondary transfer roller 30 or the intermediate transfer belt 20 can be prevented.

When the sheet P is a thick paper, the separation speed is reduced and the separation start time is set to be earlier. Therefore, while preventing attachment of the sheet P to the secondary transfer roller 30 or the intermediate transfer belt 20, the time of the separation action can be reduced. Accordingly, various contact and separation action times to a subsequent sheet can be reduced and the conveying speed can be increased.

In both cases of the sheet P having a thick paper in FIG. 8A and the sheet P having a thin paper in FIG. 8B, as the opposing roller 24 is moved to the separated position (the time t10 and a time t20), the movement of the opposing roller 24 stops.

As described above, even when sheets have different thicknesses, in the present embodiment, start times of various actions are counted upon the time that the write start signal is asserted. Then, after having moved to the contact preparation position, the two rotary bodies start moving to the contact position and the pressing position.

It is to be noted that differences of times according to sheet thickness are emphasized in the timing charts of FIGS. 8A and 8B. However, when times of separation from the pressing position such as arrival times to the pressing position and separation start times from the pressing position are changed according to sheet thickness, the controller 100 adjusts the times within marginal areas in which an image is not formed onto the sheet P.

In addition, the intermediate transfer belt 20 and the secondary transfer roller 30 are out of contact during a period of time the sheet P is not passing due to the separation state, it is not likely wear occurs.

Generally, when the distance between rotary bodies are narrow and the contact pressure is high at the pressing position, for example, when the position of the opposing roller 24 is close to the secondary transfer roller 30 and the intermediate transfer belt 20 is pressed against the secondary transfer roller 30 more firmly, it is more likely to cause shock jitters due to coming out of the sheet P in separation from the pressing position.

In order to address this inconvenience, in this disclosure, when the transfer target material (i.e., the sheet P) comes out from the opposing region in a transfer operation, the two rotary bodies are released from the pressing state immediately before the trailing end of the transfer target material comes out from the opposing region, so that the contact pressure is reduced. This action can reduce occurrence of shock jitters due to the transfer target material coming out from the opposing region.

Embodiment 2

Figure 9:
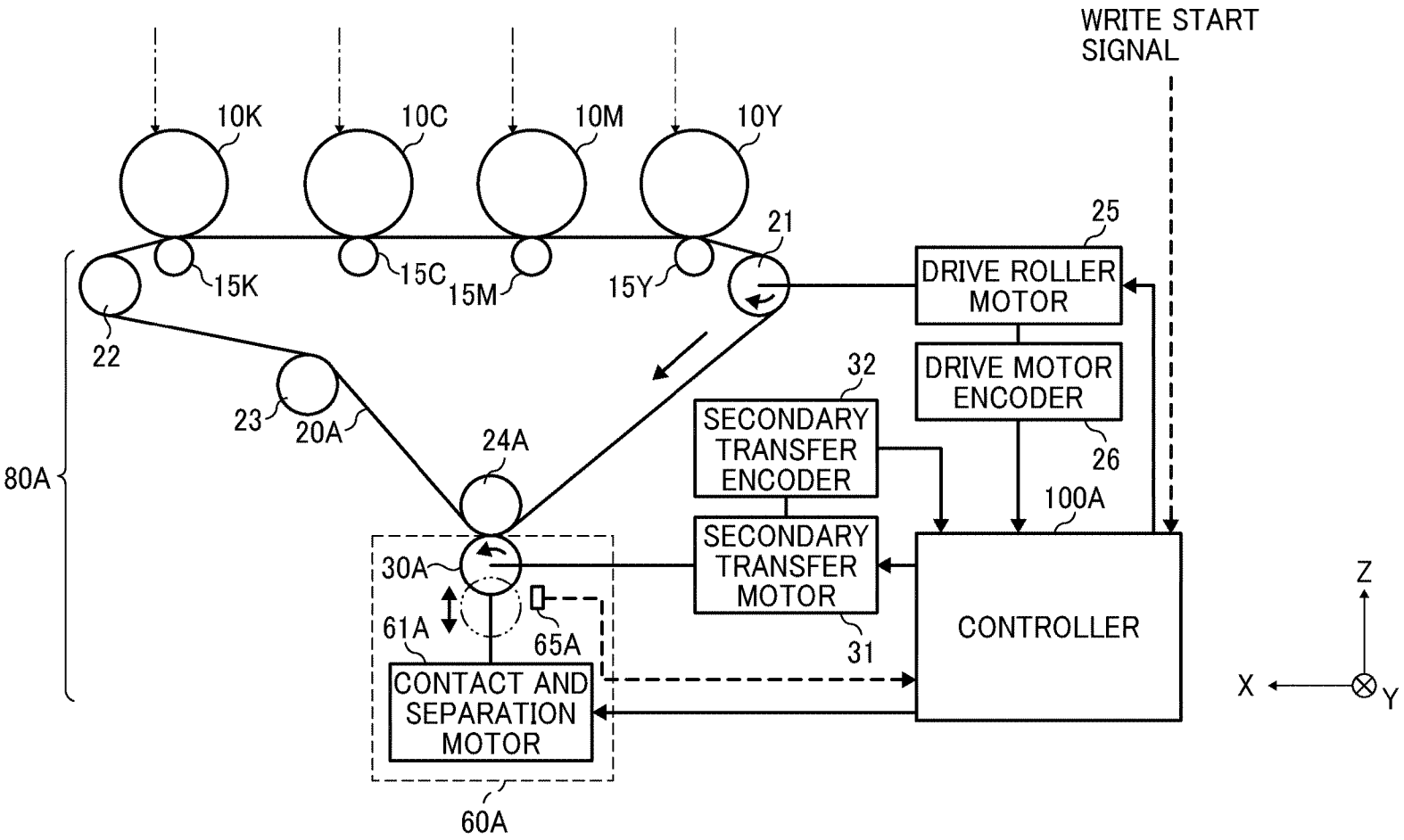
FIG. 9 is a schematic diagram illustrating a configuration of a transfer device including a contact and separation mechanism according to Embodiment 2 of this disclosure.

FIG. 9 is a schematic diagram illustrating a configuration of a sheet conveyor 80A that functions as a material conveyor and includes a contact and separation mechanism 60A according to Embodiment 2 of this disclosure.

In the configuration of Embodiment 1 illustrated in FIG. 2, the opposing roller 24 is moved to cause the position of the surface of an intermediate transfer belt 20A moves to the secondary transfer roller 30. By contrast, in the configuration of Embodiment 2 illustrated in FIG. 9, a secondary transfer roller 30A moves to contact or separate from an opposing roller 24A that presses the intermediate transfer belt 20A.

In this configuration of Embodiment 2 illustrated in FIG. 9, the secondary transfer roller 30A functions as a first rotary body and the intermediate transfer belt 20A functions as a second rotary body. In this configuration of Embodiment 2, as the entire part of the secondary transfer roller 30A moves, the surface of the secondary transfer roller 30A moves.

Even in this configuration, when executing the contact and separation operations, a controller 100A controls a contact and separation motor 61A that functions as a moving and driving device to move the secondary transfer roller 30A. However, the controls and times are same as those in FIG. 4 through FIG. 8B.

In the above-described examples, a sheet conveyor that executes position control in the contact and separation operations of the rotary bodies according to this disclosure is a secondary transfer device that transfers an image formed based on image data including electronic information onto a recording medium in an image forming apparatus such as a copier, a facsimile machine, and a printer. However, the configuration of the sheet conveyor is not limited thereto.

That is, in the above-described examples, an intermediate transfer system is described regarding contact and separation of two rotary bodies. However, an image forming apparatus to which this disclosure can be applied may not include the intermediate transfer system. For example, a direct transfer system in which a photoconductor and a rotary body disposed opposing the photoconductor contact and separate from each other can be applied to this disclosure.

Embodiment 3

Figure 10:
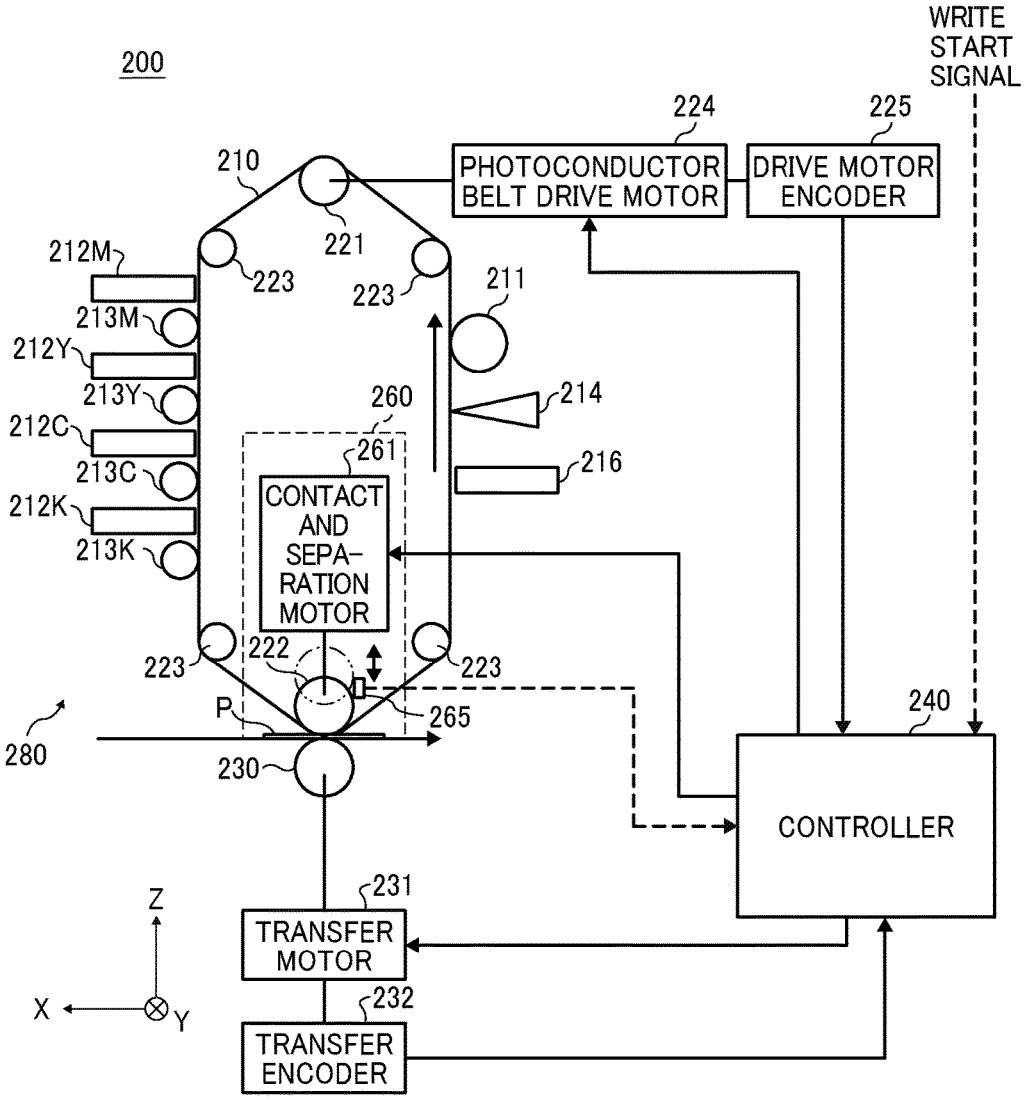
FIG. 10 is a schematic diagram illustrating an internal configuration of an image forming apparatus employing a direct transfer system, according to Embodiment 3 of this disclosure.

FIG. 10 is a schematic diagram illustrating an internal configuration of an image forming apparatus 200 employing a direct transfer system, including a sheet conveyor 280 that functions as a material conveyor and includes a contact and separation mechanism 260, according to Embodiment 3 of this disclosure.

In the image forming apparatus 200 illustrated in FIG. 10, a charging device 211, exposure devices 212M, 212Y, 212C, and 212K, developing devices 213M, 213Y, 213C, and 213K, a cleaning device 214, an electric discharging device 216, and a transfer roller 230 are disposed around a photoconductor belt 210. In the image forming apparatus 200 employing the direct transfer system, the charging device 211, the exposure devices 212M, 212Y, 212C, and 212K, and the developing devices 213M, 213Y, 213C, and 213K function as an image forming device.

In this configuration of the image forming apparatus 200 illustrated in FIG. 10, the exposure devices 212M, 212Y, 212C, and 212K, each of which functioning as an optical writing device, emit respective laser light beams corresponding to respective colors toward the charged photoconductor belt 210, so as to write respective latent images. Then, the developing devices 213M, 213Y, 213C, and 213K develop the respective latent images on the photoconductor belt 210 with toners into visible toner images. By repeating optical writing and development by the number of toner colors, a color image is formed on the photoconductor belt 210.

The color image formed on the photoconductor belt 210 is transferred on a sheet P at a position where the photoconductor belt 210 and the transfer roller 230 hold the sheet P therebetween.

The transfer roller 230 is rotated by a transfer motor 231.

After the image transfer, the electric discharging device 216 removes residual electrostatic charge from the surface of the photoconductor belt 210, and then the cleaning device 214 removes residual toner from the surface of the photoconductor belt 210 to clean the photoconductor belt 210.

In this configuration of the image forming apparatus 200 illustrated in FIG. 10, the photoconductor belt 210 is wound around multiple rollers including a drive roller 221, an opposing roller 222, and rollers 223, and rotates along with rotation of the drive roller 221 that is driven by a photoconductor belt drive motor 224 in a direction indicated by arrow in FIG. 10.

In Embodiment 3 of FIG. 10, the opposing roller 222 contacts and separates from the transfer roller 230. In this configuration, the photoconductor belt 210 functions as a first rotary body and the transfer roller 230 function as a second rotary body. In Embodiment 3, a region where the photoconductor belt 210 and the transfer roller 230 face each other in a sheet conveyance passage is referred to as an "opposing region".

When performing the contact and separation operations in this configuration, a controller 240 controls the contact and separation mechanism 260 and a contact and separation motor 261, and the opposing roller 222 around which the photoconductor belt 210 is wound is driven by the contact and separation motor 261. Accordingly, the opposing roller 222 moves to perform the contact and separation operations.

A drive motor encoder 225 is mounted on a rotary shaft of the photoconductor belt drive motor 224. A transfer encoder 232 is mounted on a rotary shaft of the transfer motor 231. The drive motor encoder 225 and the transfer encoder 232 perform the same operations as the drive motor encoder 26 and the secondary transfer encoder 32 in Embodiment 1.

A home position (HP) sensor 265 performs the same operations as the HP sensor 65 in Embodiment 1.

In Embodiment 3, a write start signal functions as a signal to instruct the start of writing an image from the exposure devices 212M, 212Y, 212C, and 212K onto the photoconductor belt 210. The write start signal of Embodiment 3 is different from the write start signal of Embodiment 1 in which there is no time difference between a writing time to the photoconductor 10 and a primary transfer time from the photoconductor 10 to the intermediate transfer belt 20 but is identical in other controls and times of FIG. 4 through FIG. 8.

FIG. 10 illustrates the configuration in which the photoconductor belt 210 functions as a first rotary body and the transfer roller 230 functions as a second rotary body. However, Embodiment 3 is not limited to have this configuration. Even in the image forming apparatus 200 employing a direct transfer system, similar to Embodiment 2, a transfer roller disposed outside a photoconductor belt may contact and separate from the photoconductor belt and the transfer roller may function as a first rotary body and the photoconductor belt may function as a second rotary body.

Further, a photoconductor that performs direct transfer is not limited to a belt but may be a drum. In a case in which a photoconductor drum is employed, not a surface of a first rotary body but a first rotary body itself moves to perform the contact and separation operations of the photoconductor drum with respect to a transfer roller.

In the above-described examples, an electrophotographic image forming apparatus is used but any other image forming apparatuses may be applied to this disclosure. For example, an image forming apparatus employing an inkjet printing system can be applied to this disclosure as long as the image forming apparatus includes a contact and separation mechanism in which two rotary bodies disposed opposing each other contact and separate from each other.

Embodiment 4

Figure 11:
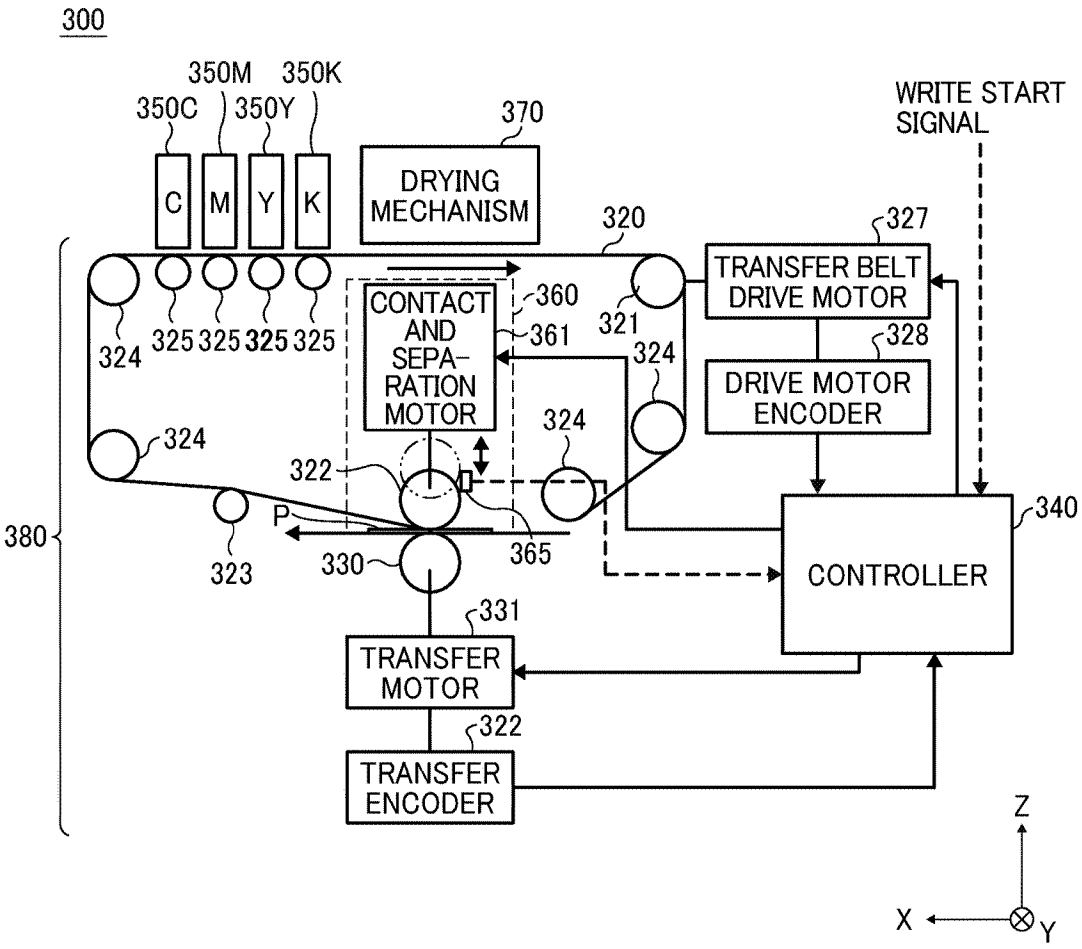
FIG. 11 is a schematic diagram illustrating a configuration inside an image forming apparatus employing an inkjet printing system, according to Embodiment 4 of this disclosure.

FIG. 11 is a schematic diagram illustrating an internal configuration of an image forming apparatus 300 employing an inkjet printing system, including a sheet conveyor 380 that functions as a material conveyor and includes a contact and separation mechanism 360, according to Embodiment 4 of this disclosure.

In the image forming apparatus 300 employing an inkjet printing system of FIG. 11, head units 350C, 350M, 350Y, and 350K function as an image forming device.

In the configuration of Embodiment 4, the head units 350C, 350M, 350Y, and 350K discharge ink drops to form an image on an outer circumferential surface of a transfer belt 320.

A drying mechanism 370 dries the image on the transfer belt 320 to form the image into a film. Then, the image formed into a thin film on the transfer belt 320 is transferred onto a sheet P in a transfer portion in which the transfer belt 320 faces a transfer roller 330.

A cleaning roller 323 removes residual toner remaining on the surface of the transfer belt 320 to clean the transfer belt 320 after image transfer.

In the image forming apparatus 300 illustrated in FIG. 11, the head units 350C, 350M, 350Y, and 350K, the drying mechanism 370, the cleaning roller 323, and the transfer roller 330 are disposed around the transfer belt 320.

In the configuration of Embodiment 4, the transfer belt 320 is wound around a drive roller 321, an opposing roller 322, four shaping rollers 324, and four support rollers 325. The drive roller 321 is rotated by a transfer belt drive motor 327. The transfer belt 320 is rotated together with rotation of the drive roller 321 in a direction indicated by arrow in FIG. 11.

The four support rollers 325 that are disposed opposing the head units 350C, 350M, 350Y, and 350K maintain a tensioned state of the transfer belt 320 when ink drops are discharged from the head units 350C, 350M, 350Y, and 350K.

In Embodiment 4 illustrated in FIG. 11, the opposing roller 322 performs the contact and separation operations with respect to the transfer roller 330. In this configuration, the transfer belt 320 that is supported by the opposing roller 322 functions as a first rotary body and the transfer roller 330 functions as a second rotary body. In Embodiment 4, a region where the transfer belt 320 and the transfer roller 330 face each other in a sheet conveyance passage is referred to as an "opposing region".

When performing the contact and separation operations in this configuration, a controller 340 controls the contact and separation mechanism 360 and a contact and separation motor 361, and the opposing roller 322 around which the transfer belt 320 is wound is driven by the contact and separation motor 361. Accordingly, the opposing roller 322 moves to perform the contact and separation operations.

A drive motor encoder 328 is mounted on a rotary shaft of the transfer belt drive motor 327. A transfer encoder 332 is mounted on a rotary shaft of the transfer motor 331. The drive motor encoder 328 and the transfer encoder 332 perform the same operations as the drive motor encoder 26 and the secondary transfer encoder 32 in Embodiment 1.

A home position (HP) sensor 365 performs the same operations as the HP sensor 65 in Embodiment 1.

In Embodiment 4, the controller 340 obtains a write start signal (a discharge start signal) that functions as a signal to instruct the start of discharging ink drops from the head units 350C, 350M, 350Y, and 350K to the transfer belt 320. The write start signal of Embodiment 4 is different from the write start signal of Embodiment 1 in which there is no time difference between the writing time to the photoconductor 10 and the primary transfer time from the photoconductor 10 to the intermediate transfer belt 20 but is identical in other controls and times of FIG. 4 through FIG. 8.

It is to be noted that FIG. 11 illustrates the configuration in which the transfer belt 320 functions as a first rotary body and the transfer roller 330 functions as a second rotary body. However, Embodiment 4 is not limited to have this configuration. Even in the image forming apparatus 300 employing an inkjet printing system, similar to Embodiment 2, a transfer roller disposed outside a photoconductor belt may contact and separate from the photoconductor belt and the transfer roller may function as a first rotary body and the transfer belt may function as a second rotary body.

Further, the above-described sheet conveyor can be applied not only to a transfer device but also other rotary body driving devices that are effective to restrain the speed fluctuation generated to at least one rotary body by impact generated when a transfer target material enters the opposing region between the first rotary body and the second rotary body. As another example of an image forming apparatus, a fixing device, a permeation agent application device can be applied but are not limited. Further, if a sheet conveying mechanism in which rotary bodies contact and separate from each other is employed, the sheet conveying mechanism may not be included in an image forming apparatus. For example, the sheet conveyor can be applied as a sheet inspection device.

Further, in the above-described example, the opposing roller 24 is a roller but an opposing member applicable to this disclosure is not limited thereto. For example, the opposing member may be any member that biases a part of the intermediate transfer belt 20 that functions as a first rotary body but may not be a roller. For example, a shaft that does not rotate may be applied.

Further, in the configurations of Embodiment 1 and Embodiment 3, the secondary transfer roller or other transfer member that functions as a second rotary body is a roller but is not limited thereto as long as the second rotary body can contact and separate from the first rotary body. For example, the second rotary body may be a belt.

Further, in the configurations of Embodiment 2 and Embodiment 4, the secondary transfer roller or other transfer member that functions as a first rotary body is a roller but is not limited thereto as long as the first rotary body can contact and separate from the second rotary body. For example, the first rotary body may be a belt that is wound around a movable roller or a shaft.

Further, in the above-described configurations, the controller counts each of the times to control. However, the controller may start counting from a reference time, for example, the entire time of assertion of the write start signal. For example, the controller may manage the start of movement of the two rotary bodies to the separation direction based on the counts from other sensor such as the counts from the detection time of the HP sensor 65.

Further, in the above-described example, at least a surface of one of the first rotary body and the second rotary body is moved but the action is not limited thereto. For example, at least the surface of both the surface of the first rotary body and the surface of the second rotary body may be moved. When moving both of the two rotary bodies, it is preferable to move such that the distance between rotary bodies, i.e., the first rotary body and the second rotary body, corresponds to the distance illustrated in FIG. 6, FIG. 8A, and FIG. 8B.

Further, in the above-described example, one of the first rotary body and the second rotary body is a roller and the other of the first rotary body and the second rotary body is a belt. However, the configuration is not limited thereto. For example, both of the first rotary body and the second rotary body may be rollers. Or, both of the first rotary body and the second rotary body may be belts.

Further, in the above-described example, at least the surface of one of the first rotary body and the second rotary body moves in a vertical direction. However, the configuration is not limited thereto. For example, when the first rotary body is a belt, the entire belt rotates about a roller other than a roller contacting and stretching the belt at a portion where the belt contacts the second rotary body.

Further, in the above-described example, the conveying speed is switched from the first speed to the second speed based on the number of steps of a predetermined stepping motor. However, the configuration is not limited thereto. For example, a sensor may be further provided to detect a distance between the first rotary body and the second rotary body. With this configuration, when the distance reached the threshold distance, the conveying speed can be switched from the first speed to the second speed. In this case, the threshold distance may be changed according to the thickness of the sheet-like transfer target material.

Further, a sheet-like transfer target material or a transfer target sheet that is conveyed in the sheet conveyor according to this disclosure is not limited to a recording medium such as a paper. For example, the "sheet-like transfer target material" indicates a material to which liquid such as ink and powder such as toner can adhere at least temporarily and corresponds to a material to which liquid or powder adheres to fix or penetrate. Specifically, the sheet-like transfer target material includes target recording media such as papers, recording media, recording sheets, films, and cloths; electronic devices such as piezoelectric elements; media such as powder layers, organ models, and inspection cells; and other materials to which liquid and powder are attached, unless otherwise specified.

Further, in the above-described examples, in a case in which any sheet conveyor is not applied to an image forming apparatus, the material of a "sheet-like transfer target material" may include any sheet-like material that can be applied to a sheet conveyor that performs predetermined contact and separation operations, for example, a material of paper, thread, fabric, cloth, leather, metal, plastic, glass, wood, or ceramics even if liquid or powder is not attachable to the sheet-like material.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A material conveyor comprising:

a first rotary body;

a second rotary body, disposed opposing the first rotary body and forming nip region through which a material is conveyable; and a drive motor configured to cause at least a surface, of at least one of the first rotary body and the second rotary body to move, between a separated position at which the first rotary body and the second rotary body are separated from each other and a contact position at which both the first rotary body and the second rotary body are configured to contact and convey the material, the drive motor being configured to move the second rotary body from the separated position to the contact position at:

a first moving speed from the separated position to an intermediate position between the separated position and the contact position; and a second moving speed slower than the first moving speed, from the intermediate position to the contact position, after movement at the first moving speed, wherein the drive motor is configured to insert a temporary stop between the first moving speed and the second moving speed based on a type of conveyed material.

2. The material conveyor according to claim 1, wherein the drive motor is configured to cause the second rotary body to move:

at the first moving speed to the intermediate position before a leading end of the material reaches the nip region; and at the second moving speed to the contact position in synchronization with arrival of a leading end of the material to the nip region.

3. The material conveyor according to claim 1, wherein the drive motor is configured to:

cause the at least the surface of the at least one of the first rotary body and the second rotary body to move to a pressing position closer to the at least the surface of the at least one of the first rotary body and the second rotary body than the contact position, and cause the at least the surface of the first rotary body and the second rotary body to move to the pressing position after a time at which the leading end of the material reaches the nip region.

4. The material conveyor according to claim 1,
wherein the drive motor is configured to:
cause the at least the surface of the at least one of the first rotary body and the second rotary body to move to a pressing position, the pressing position being closer to the at least the surface of the at least one of the first rotary body and the second rotary body than the contact position, and
start to increase a distance between the pressing position and the at least the surface of the at least one of the first rotary body and the second rotary body earlier than a time at which a trailing end of the material is conveyed out from the nip region.

5. The material conveyor according to claim 1,
wherein the material includes a transfer target sheet and wherein the drive motor is configured to:
cause the at least the surface of the at least one of the first rotary body and the second rotary body to move to a pressing position, the pressing position being closer to the at least the surface of the at least one of the first rotary body and the second rotary body than the contact position, and
when in the pressing position, increasing a distance between the at least the surface of the at least one of the first rotary body and the second rotary body at an earlier time when the transfer target sheet is a transfer target sheet having a first thickness than when the target transfer sheet is a transfer target sheet having a second thickness greater than the first thickness.

6. The material conveyor according to claim 1,
wherein the material includes a transfer target sheet and wherein the drive motor is configured to:
cause the at least the surface of the at least one of the first rotary body and the second rotary body to move to a pressing position, the pressing position being closer to the at least the surface of the at least one of the first rotary body and the second rotary body than the contact position, and
when conveying a transfer target sheet of a first thickness, cause the at least the surface of the first rotary body and the second rotary body to move from the pressing position to the separated position at a speed lower than a speed when conveying a transfer target sheet of a second thickness greater than the first thickness.

7. The material conveyor according to claim 1, further comprising a controller configured to control the drive motor,
wherein the material includes a transfer target sheet and wherein the controller is configured to:
obtain information of type of the transfer target sheet, and
adjust a distance from the separated position to a position according to a thickness of the transfer target sheet.

8. The material conveyor according to claim 1,
further comprising a controller configured to control the drive motor,
wherein, when a conveyance speed of the material is equal to or smaller than a threshold value, the controller is configured to take a temporary stop time during transition of the conveyance speed of the material when the second rotary body goes from the first moving speed to the second moving speed.

9. A transfer device comprising the material conveyor according to claim 1,
wherein one of the first rotary body and the second rotary body includes an image bearer, and
wherein an image borne on the first rotary body is transferred onto the material in the nip region.

10. An image forming apparatus comprising:
an image forming device configured to form an image on an image bearer; and
the transfer device according to claim 9.

11. The material conveyor according to claim 1,
wherein at least one of the first rotary body and the second rotary body is a roller.

12. The material conveyor according to claim 1,
wherein each of the first rotary body and the second rotary body are rollers.

13. The material conveyor according to claim 1,
wherein at least one of the first rotary body and the second rotary body is a belt.

14. The material conveyor according to claim 1,
wherein each of the first rotary body and the second rotary body are belts.

15. The material conveyor according to claim 1,
wherein the drive motor configured to:
move the at least the surface of the at least one of the first rotary body and the second rotary body to a pressing position, the pressing position being closer to the at least the surface of the at least one of the first rotary body and the second rotary body than the contact position, and
cause a time to start increasing a distance between the pressing position and the at least the surface of the at least one of the first rotary body and the second rotary body earlier when the material conveyed is a material of a first thickness compared to the material conveyed being of a second thickness greater than the first thickness.

16. A method of position control of rotary bodies comprising:
moving at least a surface of at least one of a first rotary body and a second rotary body, disposed opposing the first rotary body, in a region between a separated position, at which the first rotary body and the second rotary body are separated from each other, and a contact position, at which the first rotary body and the second rotary body are configured to contact each other and convey a material,
the moving including moving the at least the surface of the at least one of the first rotary body and the second rotary body from the separated position at a first moving speed and moving the at least the surface of the at least one of the first rotary body and the second rotary body, prior to reaching the contact position, at a second moving speed slower than the first moving speed;
moving the at least the surface of the at least one of the first rotary body and the second rotary body at the first moving speed to the position before a leading end of the material reaches a nip region;
temporarily stopping the at least the surface of the at least one of the first rotary body and the second rotary body; and
moving the at least the surface of the at least one of the first rotary body and the second rotary body at the second moving speed to the contact position in synchronization with arrival of the leading end of the material to the nip region.

17. A non-transitory computer readable storage medium including program code segments to, when executed by a processor in an image forming apparatus,
perform the method of claim 16.

18. A method of position control of rotary bodies comprising:

moving at least a surface of at least one of a first rotary body and a second rotary body, disposed opposing the first rotary body, at a first moving speed when the first rotary body and the second rotary body are separated from each other, and at a second moving speed, that is slower than the first moving speed, when a distance between the first rotary body and the second rotary body reaches a threshold distance, prior to reaching a contact position at which the first rotary body and the second rotary body are configured to contact and convey a material; and moving the at least the surface of the at least one of the first rotary body and the second rotary body at the first moving speed to the position before a leading end of the material reaches a nip region;

temporarily stopping the at least the surface of the at least one of the first rotary body and the second rotary body; and moving the at least the surface of the at least one of the first rotary body and the second rotary body at the second moving speed to the contact position in synchronization with arrival of the leading end of the material to the nip region.

19. A non-transitory computer readable storage medium including program code segments to, when executed by a processor in an image forming apparatus, perform the method of claim 18.

* * * * *